US010538976B2

(12) United States Patent
Scekic et al.

(10) Patent No.: US 10,538,976 B2
(45) Date of Patent: Jan. 21, 2020

(54) FLOOR WRENCH FOR A DRILLING RIG

(71) Applicant: DRILLFORM TECHNICAL SERVICES LTD., Calgary (CA)

(72) Inventors: Vladimir Scekic, New Westminster (CA); Todd McCorriston, Calgary (CA); Patrick McDougall, Calgary (CA)

(73) Assignee: DRILLFORM TECHNICAL SERVICES LTD., Calgary (CA)

( * ) Notice: Subject to any disclaimer, the term of this patent is extended or adjusted under 35 U.S.C. 154(b) by 320 days.

(21) Appl. No.: 14/889,398

(22) PCT Filed: May 5, 2014

(86) PCT No.: PCT/CA2014/000401

§ 371 (c)(1),
(2) Date: Nov. 5, 2015

(87) PCT Pub. No.: WO2014/179862

PCT Pub. Date: Nov. 13, 2014

(65) Prior Publication Data

US 2016/0102509 A1 Apr. 14, 2016

Related U.S. Application Data

(60) Provisional application No. 61/819,981, filed on May 6, 2013.

(51) Int. Cl.
*E21B 19/16* (2006.01)

(52) U.S. Cl.
CPC ..... *E21B 19/161* (2013.01); *E21B 19/166* (2013.01)

(58) Field of Classification Search
CPC .... E21B 19/161; E21B 19/163; E21B 19/165; E21B 19/166
See application file for complete search history.

(56) References Cited

U.S. PATENT DOCUMENTS 3,507,174 A 4/1970 Dickmann
3,919,902 A 11/1975 Johnson
(Continued)

FOREIGN PATENT DOCUMENTS

CA 2465530 A1 3/2004
CA 2679698 9/2008
(Continued)

OTHER PUBLICATIONS

International Search Report and Written Opinion prepared by the Canadian Intellectual Property Office dated Jun. 10, 2014, for International Application No. PCT/CA2014/000401.
(Continued)

*Primary Examiner* — Matthew R Buck
*Assistant Examiner* — Aaron L Lembo
(74) *Attorney, Agent, or Firm* — Sheridan Ross PC

(57) ABSTRACT

A floor wrench for a drilling rig floor is provided. The wrench can include a tong assembly having upper and lower tongs made up of articulated tong blocks that can move and lock together to enclose and make or break a joint between sections of drilling pipe. Each tong block can include a pair of die ram assemblies wherein each tong can have dies to grip the drilling pipe around its circumference. The tong assembly can be mounted in a frame configured for horizontal and vertical movement to and from the pipe joint. In some embodiments, the wrench can further include a pipe spinner having motorized spinners that can spin the upper pipe to form the joint prior to torqueing the joint together, or for uncoupling the upper pipe after the joint is broken.

18 Claims, 27 Drawing Sheets

(56) References Cited

U.S. PATENT DOCUMENTS

| | | | | |
|---|---|---|---|---|
| 4,295,527 | A * | 10/1981 | Russe | E21B 19/16 166/380 |
| 4,372,026 | A | 2/1983 | Mosing | |
| 4,765,401 | A | 8/1988 | Boyacklieff | |
| 5,060,542 | A * | 10/1991 | Hauk | E21B 19/163 81/57.16 |
| 5,092,399 | A | 3/1992 | Lang | |
| 6,142,041 | A | 11/2000 | Buck | |
| 6,318,214 | B1 | 11/2001 | Buck | |
| 7,707,914 | B2 | 5/2010 | Pietras et al. | |
| 7,861,618 | B2 * | 1/2011 | Pietras | E21B 19/164 81/57.11 |
| 8,020,626 | B2 | 9/2011 | Francis et al. | |
| 2004/0237726 | A1 * | 12/2004 | Schulze Beckinghausen | E21B 19/164 81/57.34 |
| 2009/0255662 | A1 | 10/2009 | Ge | |
| 2011/0030512 | A1 | 2/2011 | Begnaud, Jr. | |
| 2016/0340989 | A1 | 11/2016 | Scekic | |

FOREIGN PATENT DOCUMENTS

| | | | |
|---|---|---|---|
| CA | 2773295 | A1 | 10/2013 |
| EP | 1517000 | | 3/2005 |
| GB | 2400389 | A | 10/2004 |
| GB | 2433954 | | 7/2007 |
| WO | WO 2011/060270 | | 5/2011 |

OTHER PUBLICATIONS

European Search Report and Opinion for European Patent Application No. 14794384, dated Dec. 15, 2016, 7 pages.

International Search Report and Written Opinion for International (PCT) Patent Application No. PCT/CA2015/000029, dated Apr. 29, 2015, 6 pages.

International Preliminary Patentability Report for International (PCT) Patent Application No. PCT/CA2015/000029, dated Jul. 28, 2016, 5 pages.

Official Action for U.S. Appl. No. 15/111,903, dated Sep. 19, 2018, 6 pages.

* cited by examiner

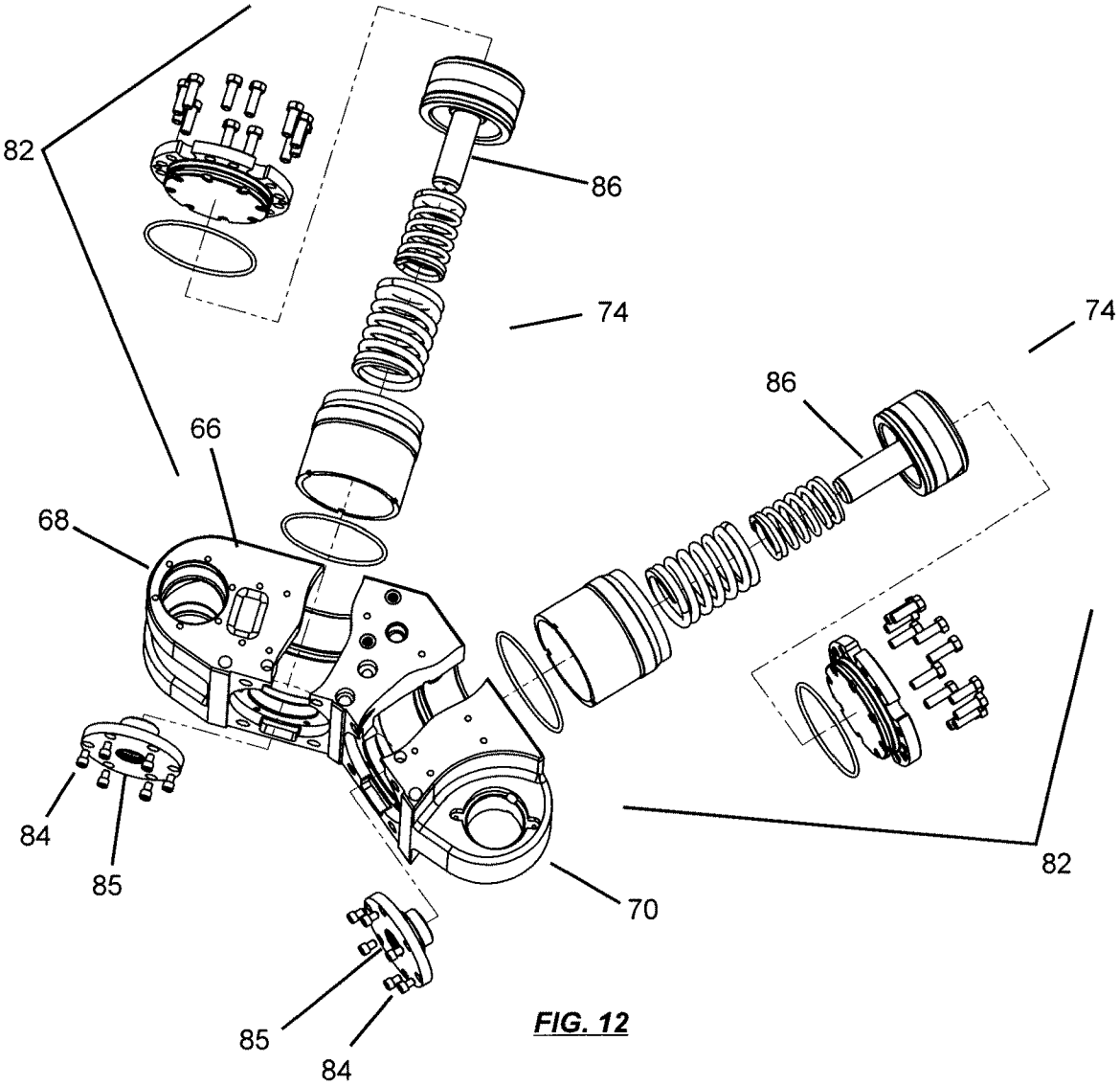
FIG. 12
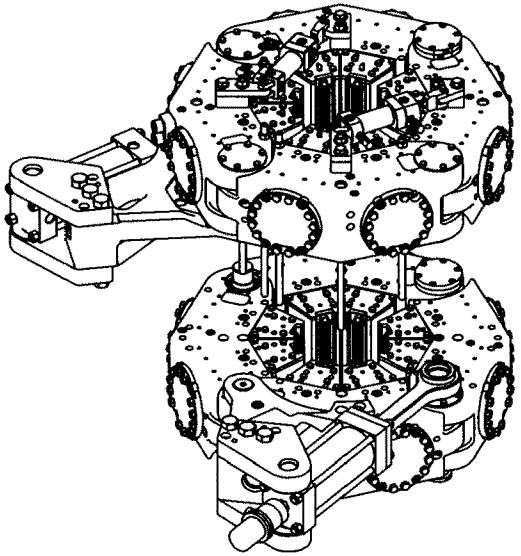

FLOOR WRENCH FOR A DRILLING RIG

CROSS REFERENCE TO RELATED APPLICATIONS

This application is a national stage application under 35 U.S.C. 371 and claims the benefit of PCT Application No. PCT/CA2014/000401 having an international filing date of May 5, 2014, which designated the United States, which PCT application claimed the benefit of U.S. Provisional Patent Application Ser. No. 61/819,981, entitled "Floor Wrench for a Drilling Rig", filed May 6, 2013, the entire disclosures of each of which are incorporated herein by reference.

TECHNICAL FIELD

The present disclosure is related to the field of automated floor wrenches for use on a drilling rig.

BACKGROUND

Automated floor wrenches for drilling rigs are known. These existing devices do have, however, deficiencies and shortcomings. Some devices are known to have two rams opposed to each other, each ram having a pair of tong dies to contact and grip drilling pipe. Other devices are known to have three rams spaced 120 degrees apart around the drill pipe, each ram having a tong die to contact and grip the pipe.

The problem with these devices is that the force required for the dies to contact and grip the pipe can score or damage the pipe surface, thus resulting in premature pipe wear. In addition, the use of only two or three rams requires significant force placed on two, three or even four points on the circumference of the pipe by the tong dies, which can cause the pipe to be squashed or deformed at those points, again resulting in premature wear and service life for the pipe.

When automated floor wrenches are used on drilling rigs, it is known to use top drives for rotating the drill string and drilling operators have been known to use the top drive to make joints between sections of drill pipe instead of using the automated floor wrench. Top drives can produce large amounts of torque, far more than what is necessary to properly torque sections of drill pipe together. Using the top drive to make the joints can apply excessive rotational force to the automated floor wrench, which is still being used to grip to lower section of drill pipe, and can cause damage to the floor wrench.

It is, therefore, desirable to provide an automated floor wrench for a drilling rig that overcomes the shortcomings of prior art devices.

SUMMARY

A floor wrench for use on a drilling rig is provided. In some embodiments, the wrench can comprise a tong assembly mounted in a frame configured for mounting on a drilling rig floor, and further configured for moving the tong assembly horizontally and vertically towards and away from a joint between sections of drilling pipe. The tong assembly can comprise an upper and lower tong.

Broadly stated, in some embodiments, a floor wrench is provided for use on a drilling rig, the floor wrench comprising: a manipulator frame configured for mounting on a drilling rig floor; a cart frame disposed within the manipulator frame, the cart frame configured for vertical movement within the manipulator frame; a manipulator cart disposed within the cart frame, the manipulator cart configured for horizontal movement within the cart frame; a power tong assembly disposed on the manipulator cart, the power tong assembly configured for making and breaking joints between sections of drilling pipe; and a control system configured for controlling the movement of the cart frame within the manipulator frame, the movement of the manipulator cart within the cart frame, and the operation of the power tong assembly.

Broadly stated, in some embodiments, the manipulator frame can further comprise manipulator frame tracks configured for mounting onto the drilling rig floor, and wherein the manipulator frame is further configured for horizontal movement along the manipulator frame tracks.

Broadly stated, in some embodiments, the power tong assembly can further comprise an upper tong disposed above a lower tong, the upper and lower tongs configured for rotational movement in a substantial horizontal plane relative to each other, the upper and lower tongs further configured for opening and enclosing a joint between the sections of drilling pipe.

Broadly stated, in some embodiments, each of the upper and lower tongs can comprise a plurality of articulated tong blocks, wherein each of the tong blocks comprise an interlocking and interchangeable configuration.

Broadly stated, in some embodiments, each of the upper and lower tongs can comprise a lock configured for locking a pair of adjacent tong blocks together.

Broadly stated, in some embodiments, each tong block can comprise at least one die ram assembly. In some embodiments, each tong block can comprise two die ram assemblies.

Broadly stated, in some embodiments, the floor wrench can further comprising a spinner assembly disposed on the manipulator cart above the power tong assembly, the spinner assembly configured for spinning a section of drilling pipe. In some embodiments, the control system is further configured for controlling the operation of the spinner assembly.

Broadly stated, in some embodiments, the spinner assembly can comprise: a pillar disposed on the manipulator cart; and a roller assembly disposed on a slide, the slide configured for vertical movement on the pillar.

Broadly stated, in some embodiments, the roller assembly can comprise a plurality of powered rollers mounted on a roller frame, the roller frame configured for moving the powered rollers away from each other to receive the section of drilling pipe and for moving the powered rollers towards and spinning the section of drilling pipe.

Broadly stated, in some embodiments, each powered roller can comprise a hydraulic motor operatively coupled to an input of a gearbox, and a roller wheel operatively coupled to an output of the gearbox.

Broadly stated, in some embodiments, the control system can comprise one or more of a group consisting of hydraulic fluid cylinders, hydraulic fluid pumps, hydraulic fluid tanks, hydraulic fluid coolers, hydraulic fluid filters, hydraulic fluid hoses, hydraulic fluid control valves and programmable logic controllers.

Broadly stated, in some embodiments, the floor wrench can further comprise a torque sensor disposed between the tong assembly and the manipulator cart, the torque sensor operatively coupled to the control system, the torque sensor configured to sense rotational forces applied to the tong assembly during operation of the floor wrench and to send a signal to the control system to stop the operation of the floor wrench when the rotational forces exceed a predetermined threshold.

Broadly stated, in some embodiments, a method is provided for making or breaking a joint between sections of drilling pipe at a drilling rig, the method comprising: using a manipulator cart on a floor wrench to position an open power tong assembly around a first section of drilling pipe; closing the power tong assembly around the first section of drilling pipe; activating die rams disposed on the power tong assembly to extend dies towards the first section of drilling pipe to grip the first section of drilling pipe; and rotating the power tong assembly and the gripped first section of drilling pipe relative to a second section of drilling pipe to make or break a joint between the first and second section of drilling pipe.

Broadly stated, in some embodiments, the method can further comprise locking the power tong assembly around the first section of drilling pipe after the power tong assembly is closed.

Broadly stated, in some embodiments, the method can further comprise using a spinner assembly disposed on the manipulator cart above the power tongs to engage and spin the second section of drilling pipe relative to the first section of drilling pipe.

Broadly stated, in some embodiments, the method can further comprise using a torque sensor to sense rotational forces applied to the power tong assembly during operation of the floor wrench.

Broadly stated, in some embodiments, the method can further comprise sending a signal from the torque sensor to a control system to stop the operation of the floor wrench when the rotational forces exceed a predetermined threshold.

Broadly stated, in some embodiments, the method can further comprise sending a signal from the torque sensor to a control system to cause the tong assembly to release the drilling pipe when the rotational forces exceed a predetermined threshold.

BRIEF DESCRIPTION OF THE DRAWINGS

FIG. 12 is an exploded cutaway perspective view depicting a tong block of the tong assembly of FIG. 11.

DETAILED DESCRIPTION OF EMBODIMENTS

Figure 1:
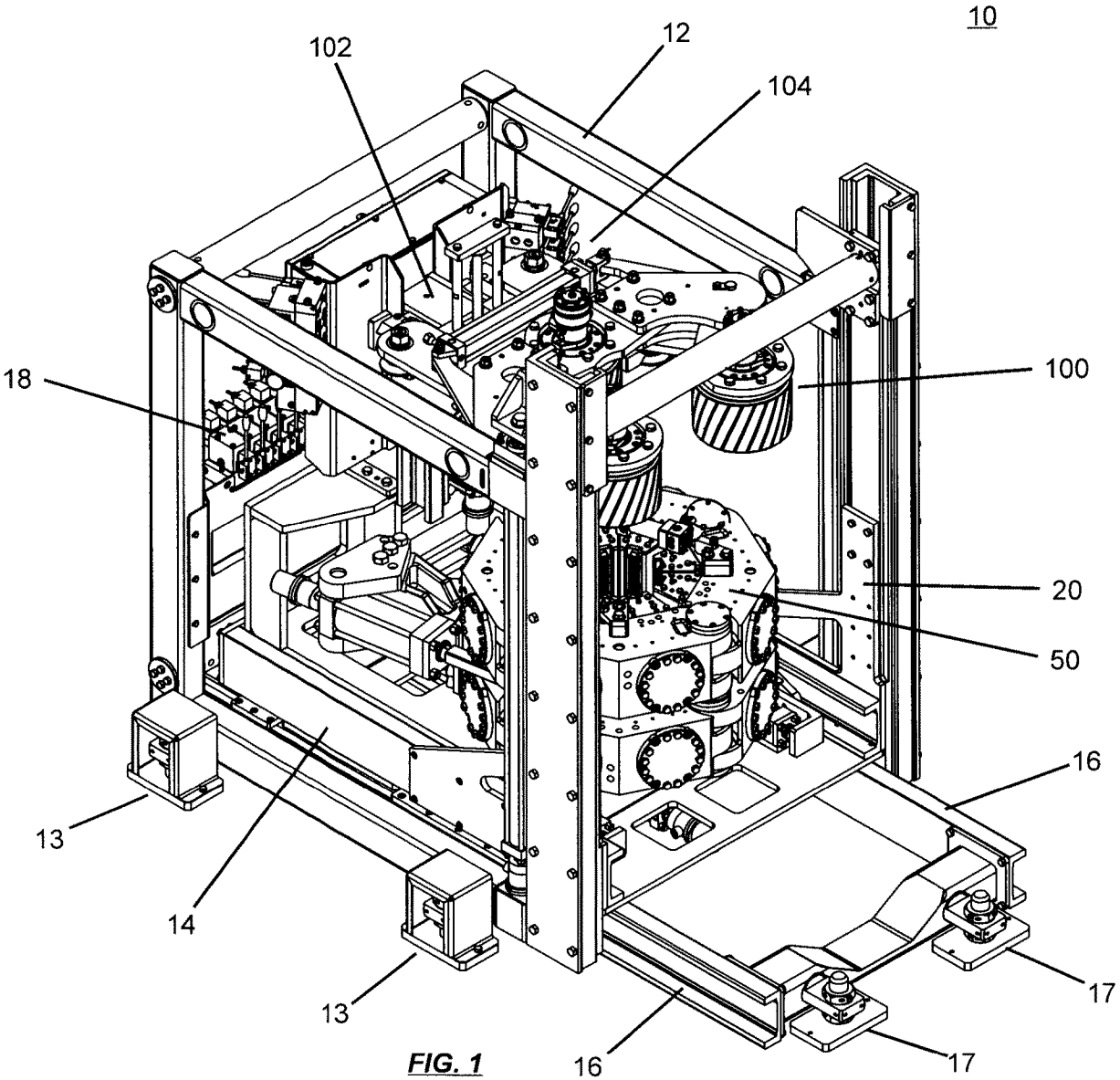
FIG. 1 is a perspective view depicting one embodiment of a floor wrench for use on a drilling rig floor.
Figure 2A:
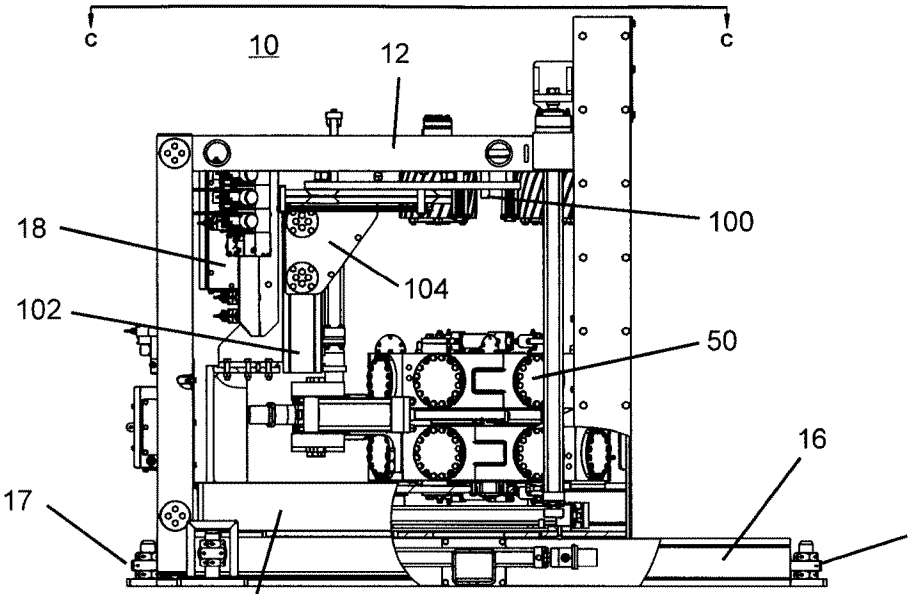
FIG. 2A is a side elevation view depicting the floor wrench of FIG. 1.
Figure 2B:
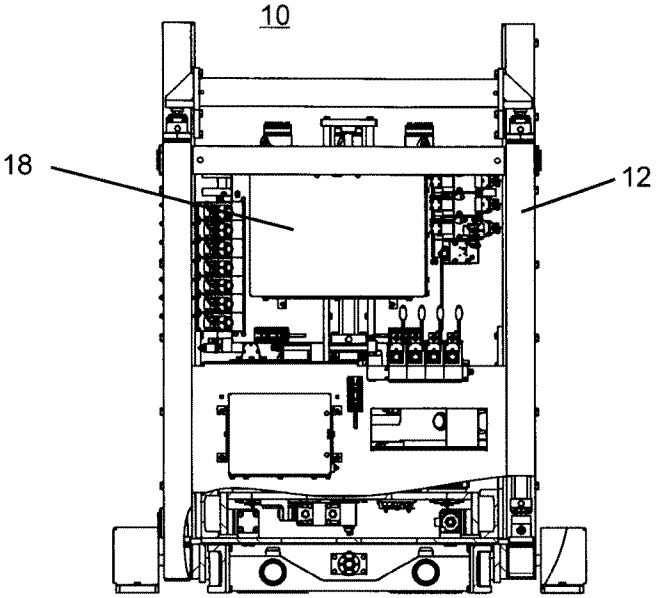
FIG. 2B is a rear end elevation view depicting the floor wrench of FIG. 1.
Figure 2C:
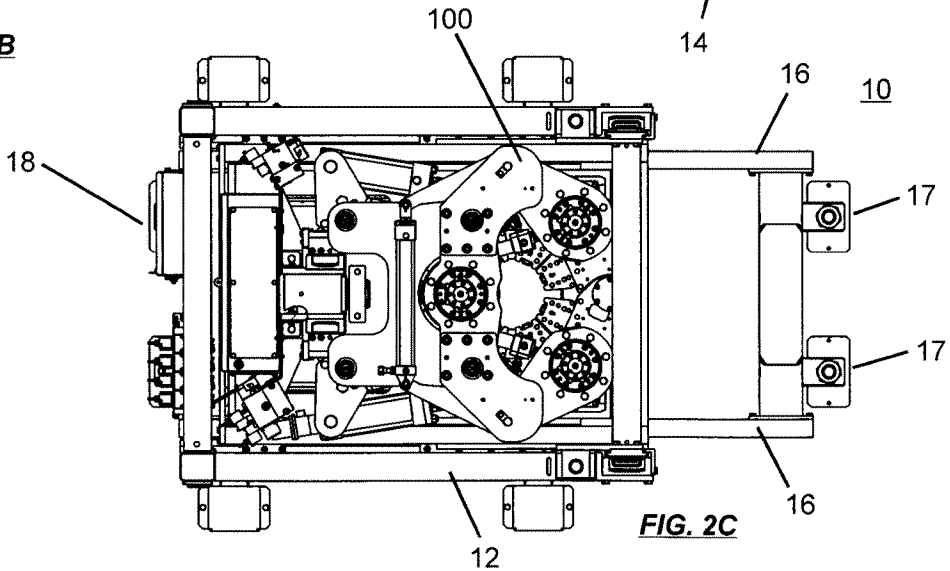
FIG. 2C is a top plan view depicting the floor wrench of FIG. 1.
Figure 3B:
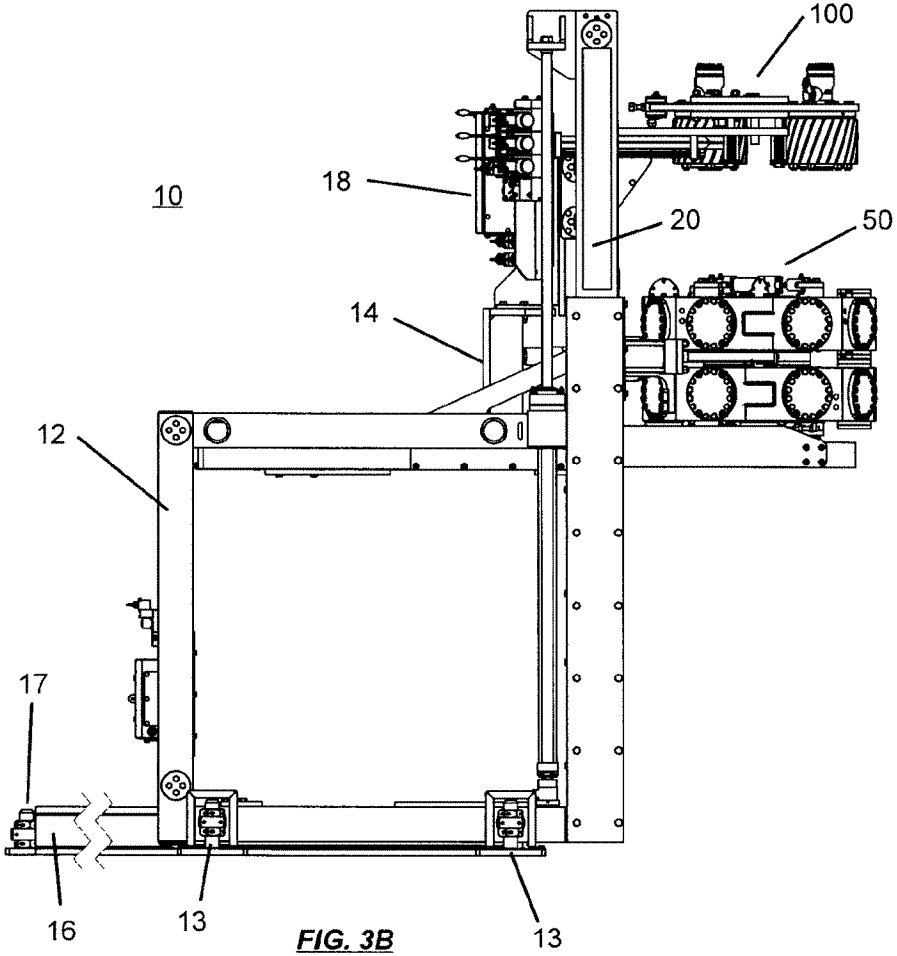
FIG. 3B is a side elevation view depicting the floor wrench of FIG. 3A in an extended position.
Figure 3A:
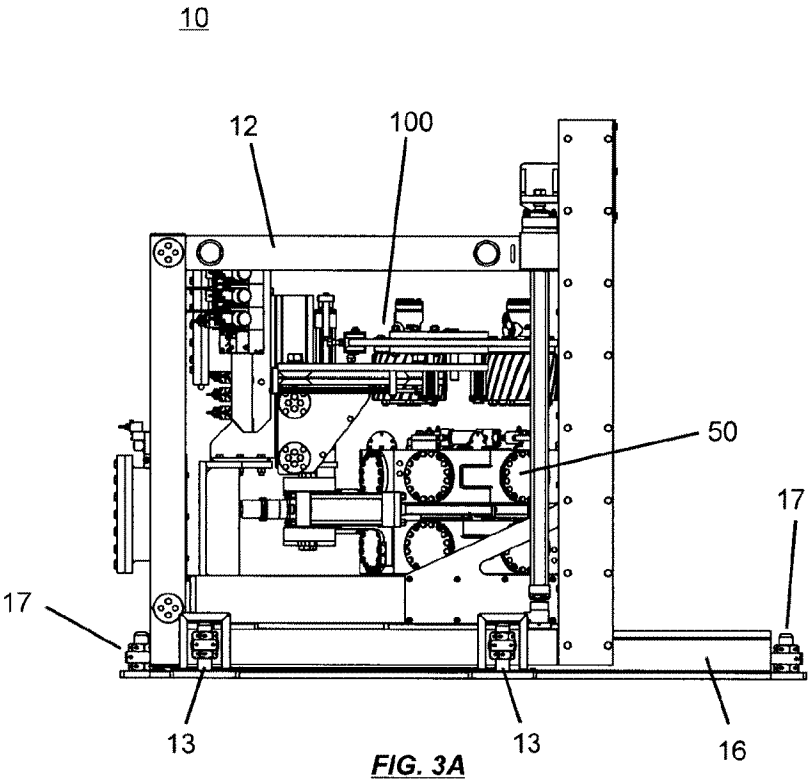
FIG. 3A is a side elevation view depicting the floor wrench of FIG. 1 in a retracted position.

An automated floor wrench for use on a drilling rig floor is provided. Referring to FIGS. 1 to 8C, an embodiment of floor wrench 10 is provided. In some embodiments, floor wrench 10 can comprise a manipulator frame 12, which can further comprise mounts 13 configured for mounting on the drilling rig floor. In some embodiments, manipulator frame 12 can be slidably disposed on manipulator tracks 16, which can further comprise mounts 17 configured for mounting on the drilling rig floor. Frame 12 can further comprise cart 14 that can be slidably disposed in cart frame 20. In some embodiments, cart 14 can be configured for vertical movement within cart frame 20. In some embodiments, floor wrench 10 can comprise tong assembly 50 operatively mounted onto cart 14. In some embodiments, floor wrench 10 can further comprise spinner assembly 100 operatively mounted on cart 14. In some embodiments, cart 14 can comprise pillar 102 and slide 104 slidably disposed thereon, wherein slide 104 can be configured for vertical movement thereon. In some embodiments, spinner assembly 100 can be disposed on slide 104.

In some embodiments, floor wrench 10 can comprise control system 18 for controlling the operation of hydraulic cylinders and motors disposed on floor wrench 10. Control system 18 can comprise one or more components selected from the group consisting of hydraulic fluid cylinders, hydraulic fluid pumps, hydraulic fluid tanks, hydraulic fluid coolers, hydraulic fluid filters, hydraulic fluid hoses, hydraulic fluid control valves and programmable logic controllers as well known to those skilled in the art.

Figure 4:
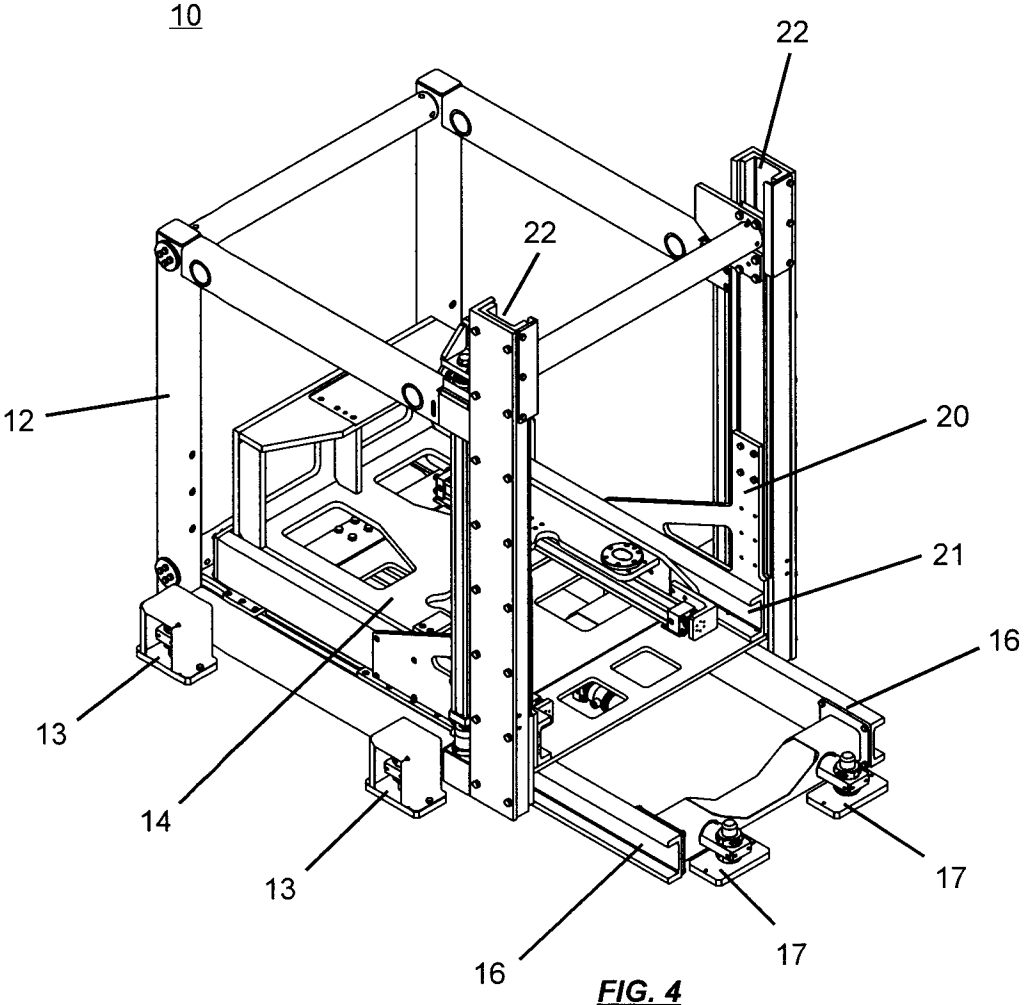
FIG. 4 is a perspective view depicting the manipulator frame and cart of the floor wrench of FIG. 1.
Figure 5:
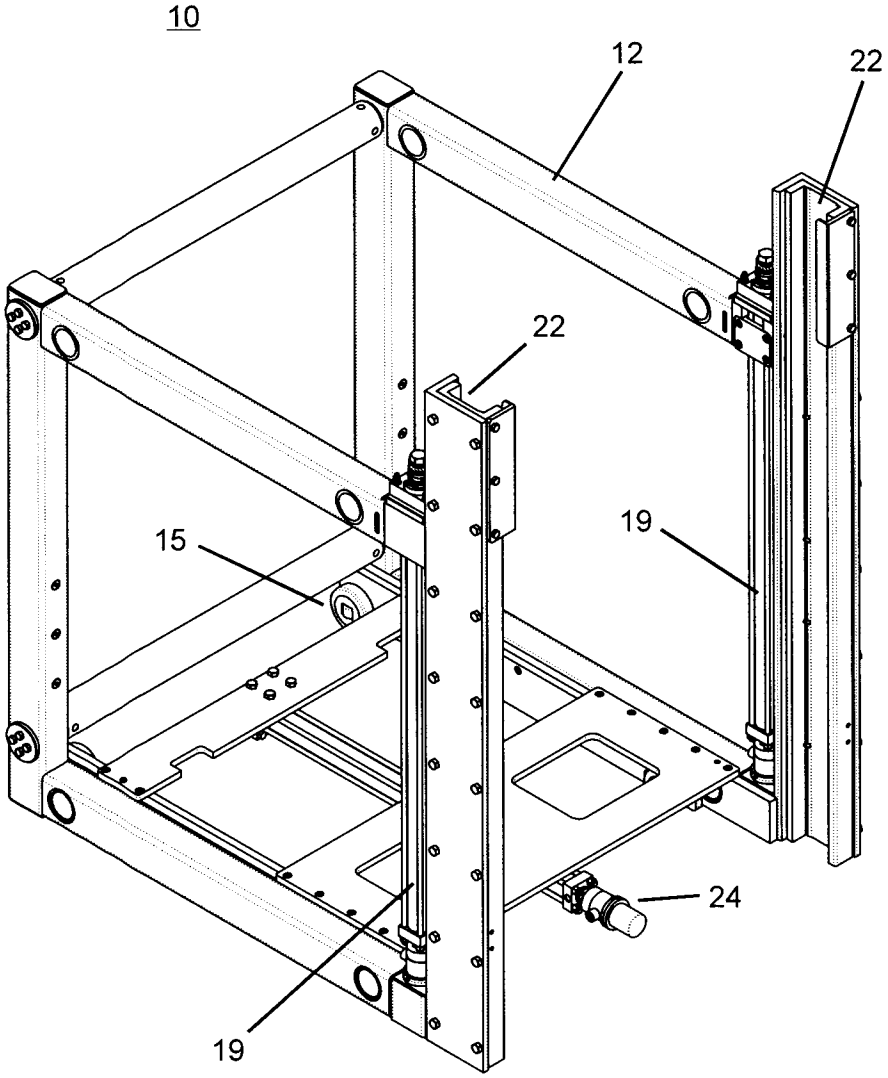
FIG. 5 is a perspective view depicting the manipulator frame of FIG. 4.

Referring to FIGS. 1 to 3A, floor wrench 10 is shown in a retracted position with tong assembly 50 nested inside manipulator frame 12. In FIG. 3B, floor wrench 10 is shown with manipulator frame 12 moved along tracks 16, cart frame 20 raised vertically within manipulator frame 12 and cart 14 extended horizontally from cart frame 20 such that tong assembly 50 is extended outwardly and upwardly with respect to manipulator frame 12. Referring to FIG. 4, floor wrench 10 is shown without tong assembly 50 and spinner assembly 100. In some embodiments, cart 14 can move horizontally within cart frame 20 along tracks 21. In further embodiments, cart frame 20 can move vertically within manipulator frame 12 along tracks 22. Referring to FIG. 5, manipulator frame 12 is shown without cart frame 20 and tracks 16. In some embodiments, manipulator frame 12 can comprise a plurality of rollers 15 for slidably engagement with tracks 16. In some embodiments, manipulator frame 12 can comprise hydraulic rams 19 for raising and lowering cart frame 20 along tracks 22. In further embodiments, manipulator frame 12 can comprise hydraulic ram 24 for attachment to a tie bar disposed between tracks 16 wherein operation of ram 24 can move manipulator frame horizontally along tracks 16.

Figure 6:
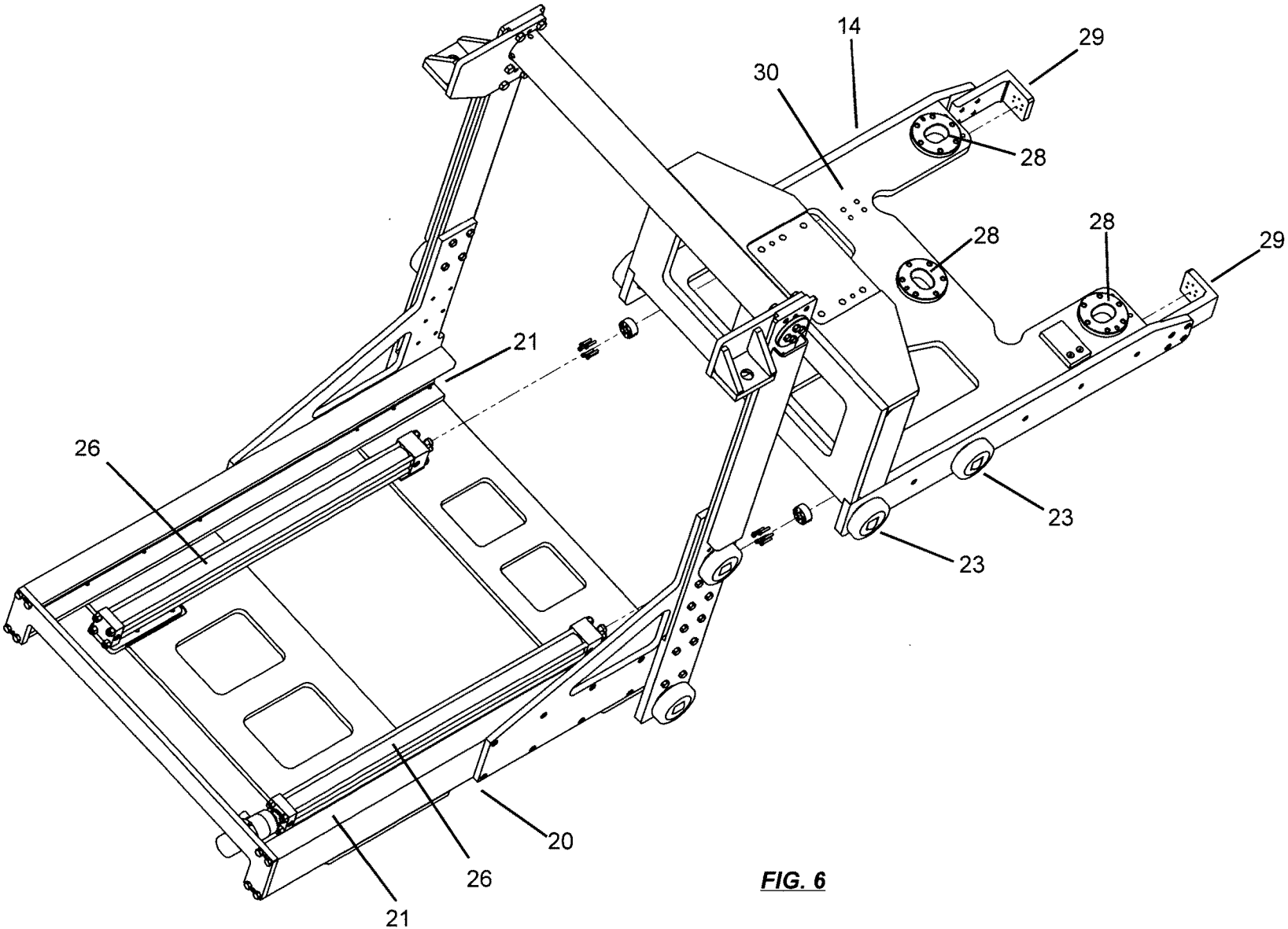
FIG. 6 is an exploded top perspective view depicting the manipulator frame and cart of FIG. 4.
Figure 7B:
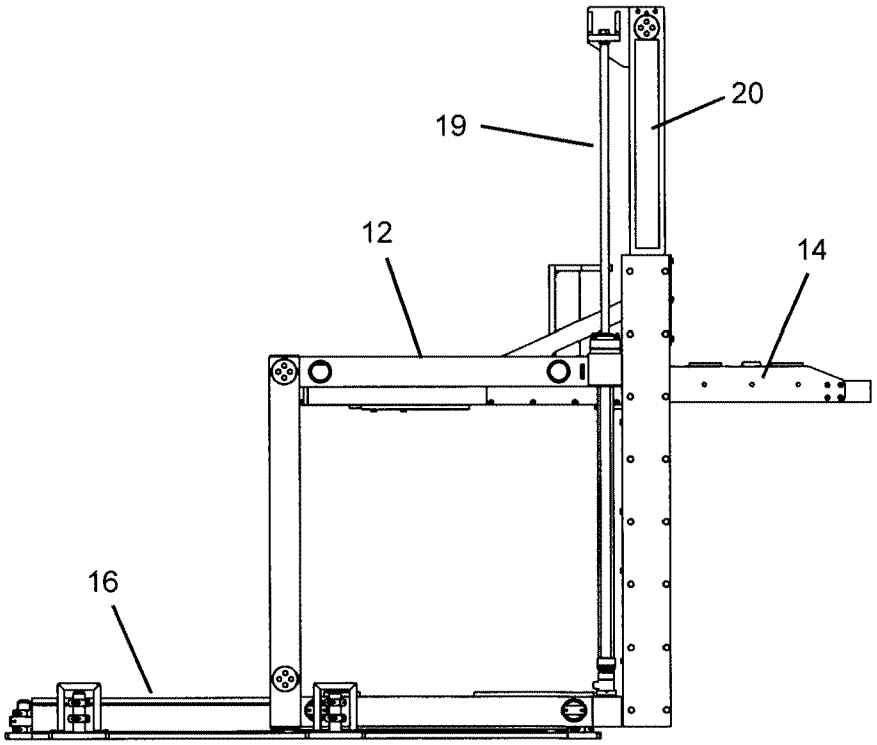
FIG. 7B is a side elevation view depicting the manipulator frame and cart of FIG. 4 in an extended position.
Figure 7A:
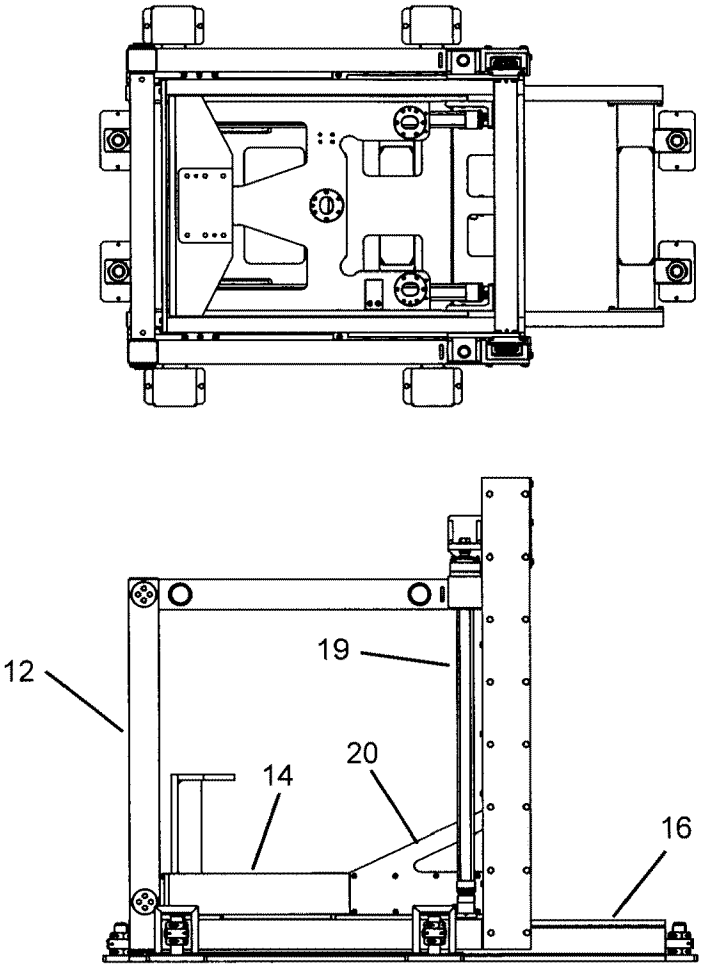
FIG. 7A is a side elevation view depicting the manipulator frame and cart of FIG. 4 in a retracted position.
Figure 8A:
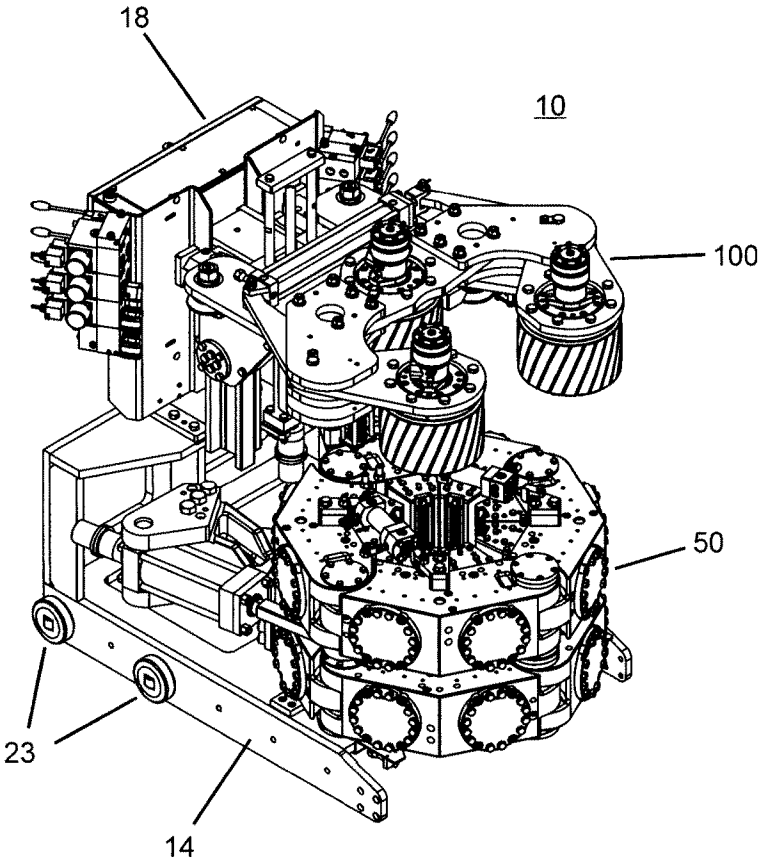
FIG. 8A is a perspective view depicting the tong assembly of FIG. 1 mounted on the cart of FIG. 4.
Figure 8C:
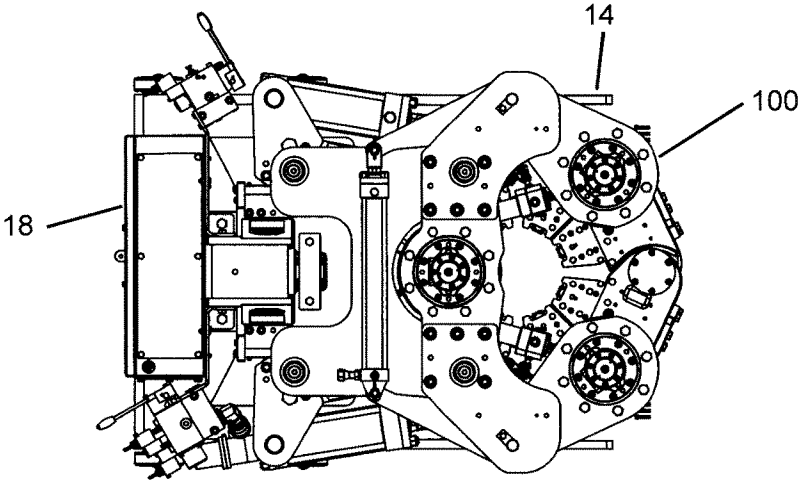
FIG. 8C is a top plan view depicting the tong assembly of FIG. 8A.
Figure 8B:
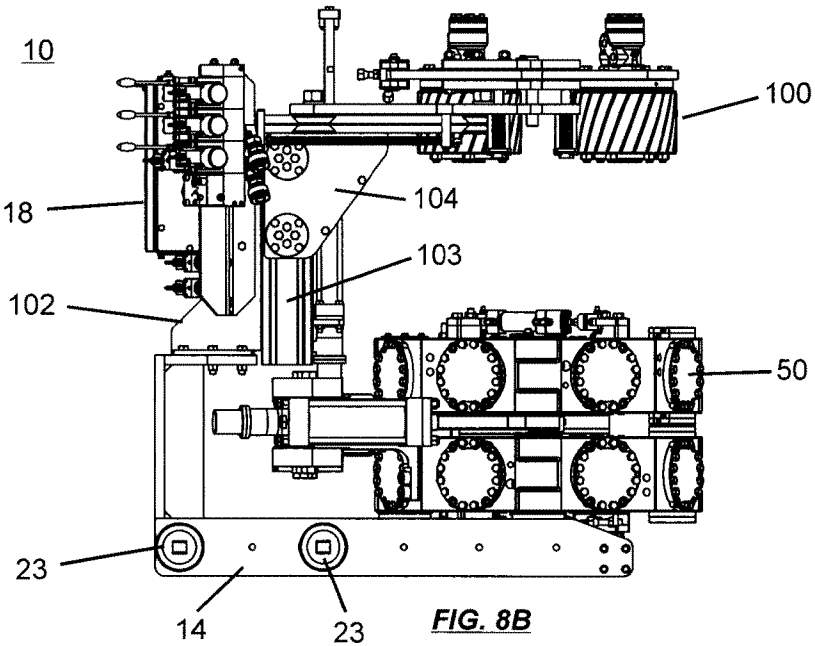
FIG. 8B is a side elevation depicting the tong assembly of FIG. 8A.

Referring to FIG. 6, an exploded view of cart frame 20 and cart 14 is shown. Rollers 23 disposed on the sides of cart 14 can allow cart 14 to move horizontally along tracks 21. In some embodiments, cart frame 20 can comprise one or more hydraulic rams 26 attached thereto and attached to brackets 29 disposed on cart 14 for moving cart 14 along tracks 21. Referring to FIG. 7A, manipulator frame 12 is shown in a retracted position on tracks 16, with cart frame 20 and cart 14 nested therein. Referring to FIG. 7B, manipulator frame 12 is shown in an extended position on tracks 16, with cart frame 20 raised within manipulator frame 12, and cart 14 extended from cart frame 20. Referring to FIGS. 8A to 8C, tong assembly 50 and spinner assembly 100 is shown mounted on cart 14.

Referring to FIGS. 9A to 19B, one embodiment of tong assembly 50 for use on floor wrench 10 is shown. In some embodiments, tong assembly 50 can comprise upper tong half 52 rotatably disposed on lower tong half 54, with central bearing 64 operatively coupling the two tong halves together wherein upper tong half 52 can rotate relative to lower tong half 54. To enable rotational movement between the tong halves, tong assembly can comprise a first hydraulic ram assembly for pushing one tong half relative to the other, and a second hydraulic ram assembly for pulling one tong half relative to the other. Whether upper tong half 52 is rotated counter-clockwise relative to lower tong half 54 (when viewed from above) to break a pipe joint, or whether upper tong half 52 is rotated clockwise relative to lower tong half 54 to make a pipe joint, there is always one ram assembly pushing and the other ram assembly pulling the tong halves relative to one another. It would be understood that the reverse motions could also be used in certain embodiments.

Figure 9A:
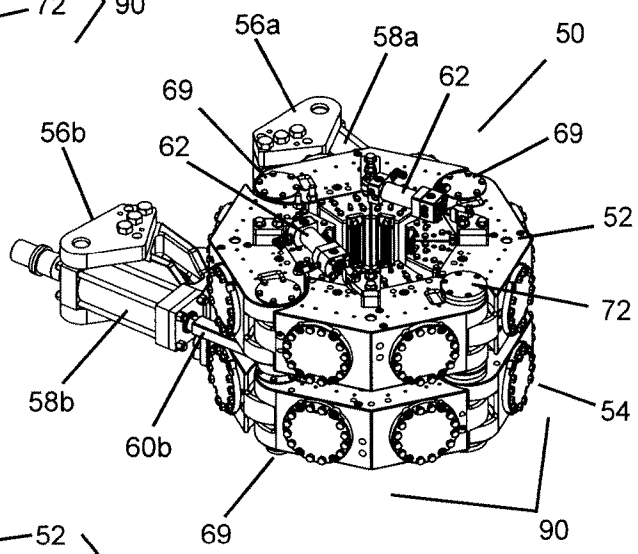
FIG. 9A is a perspective view depicting the tong assembly of FIG. 8A.
Figure 9B:
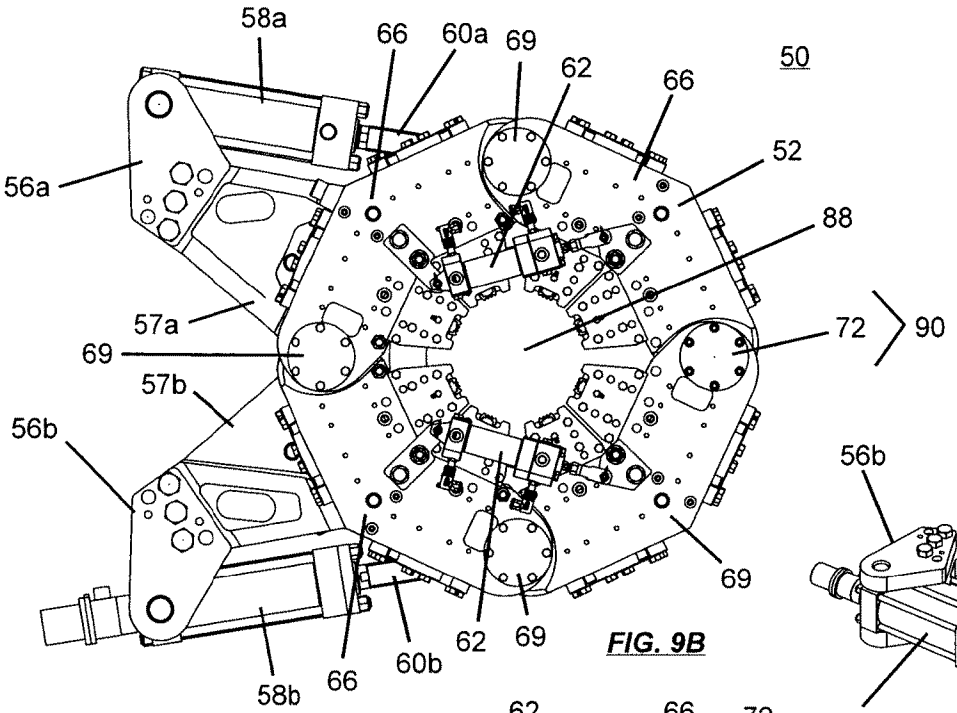
FIG. 9B is a top plan view depicting the tong assembly of FIG. 9A.
Figure 9C:
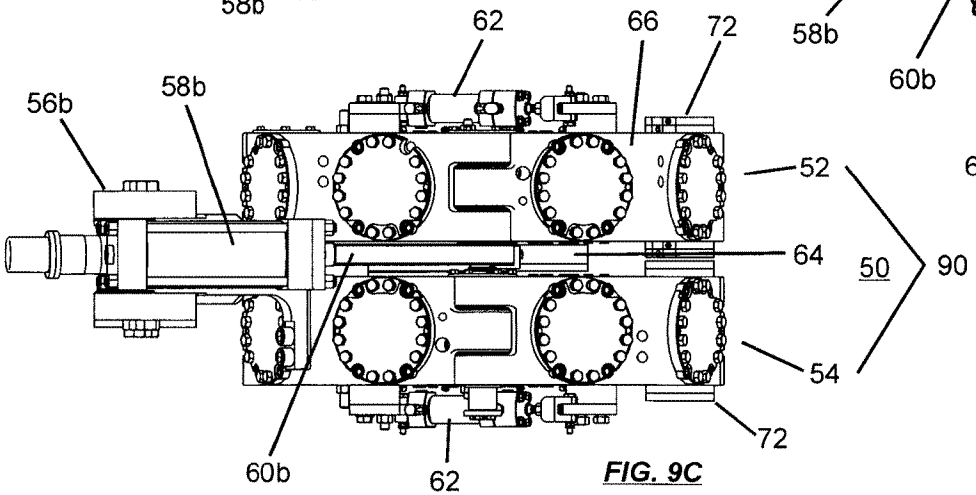
FIG. 9C is a side elevation view depicting the tong assembly of FIG. 9A.
Figure 10:
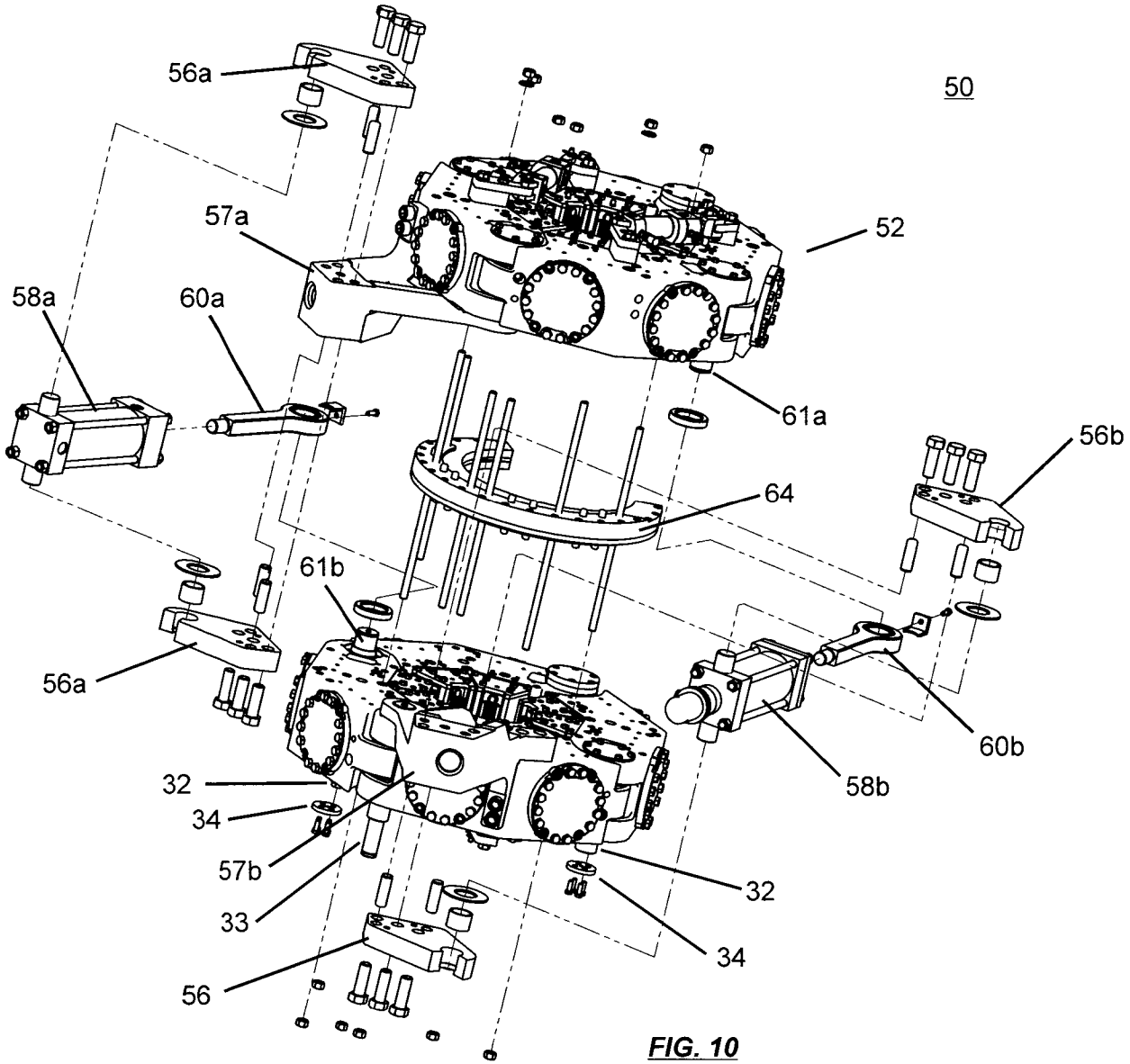
FIG. 10 is an exploded perspective view depicting the tong assembly of FIG. 9A.
Figure 11:
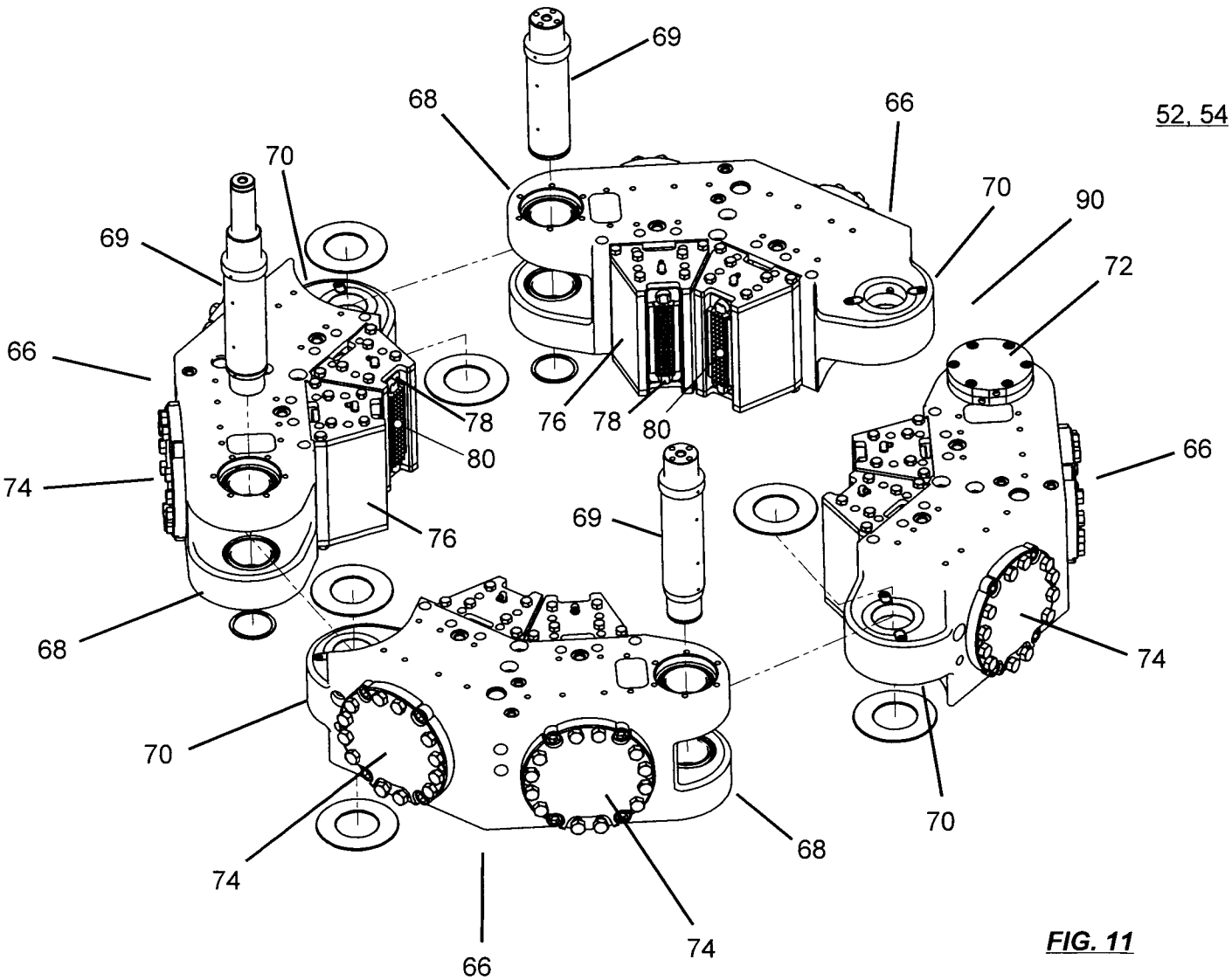
FIG. 11 is an exploded perspective view depicting one half of the tong assembly of FIG. 9A.
Figure 13B:
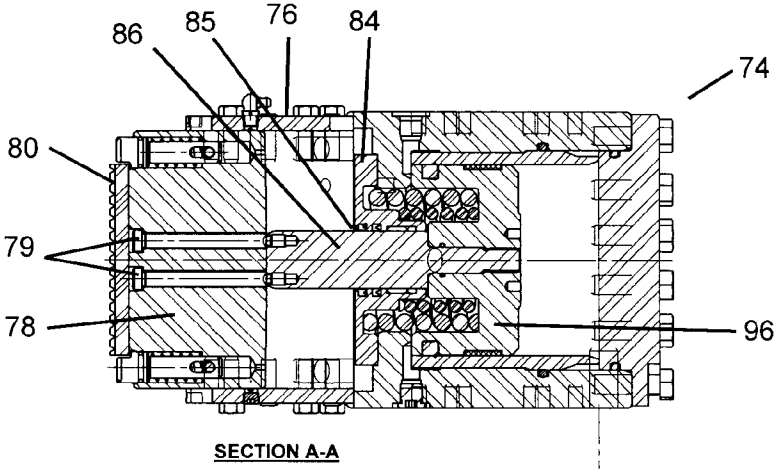
FIG. 13B is a cutaway elevation view depicting the tong block of FIG. 13A along section lines A-A with the die ram extended.
Figure 13C:
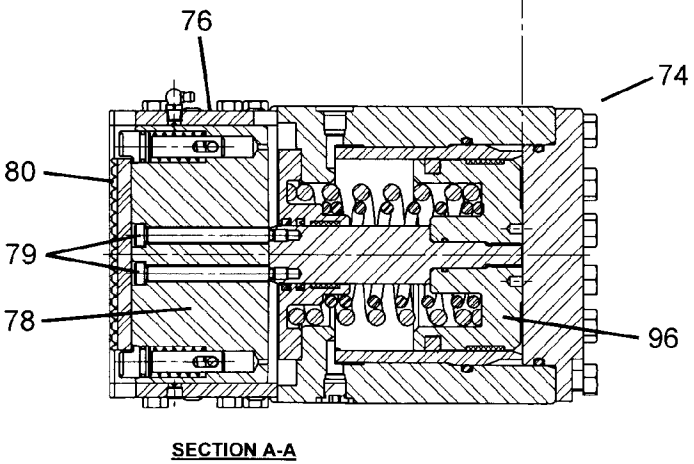
FIG. 13C is a cutaway elevation view depicting the tong block of FIG. 13B with the die ram retracted.
Figure 13A:
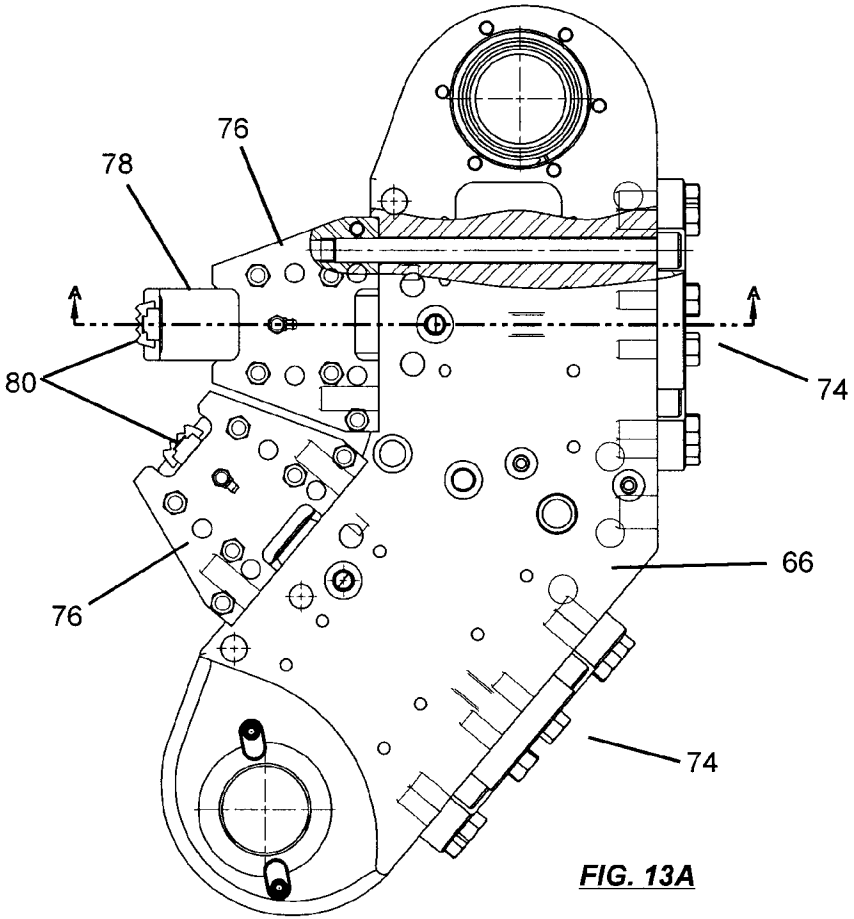
FIG. 13A is a top plan view depicting the tong block of FIG. 12.
Figure 14A:
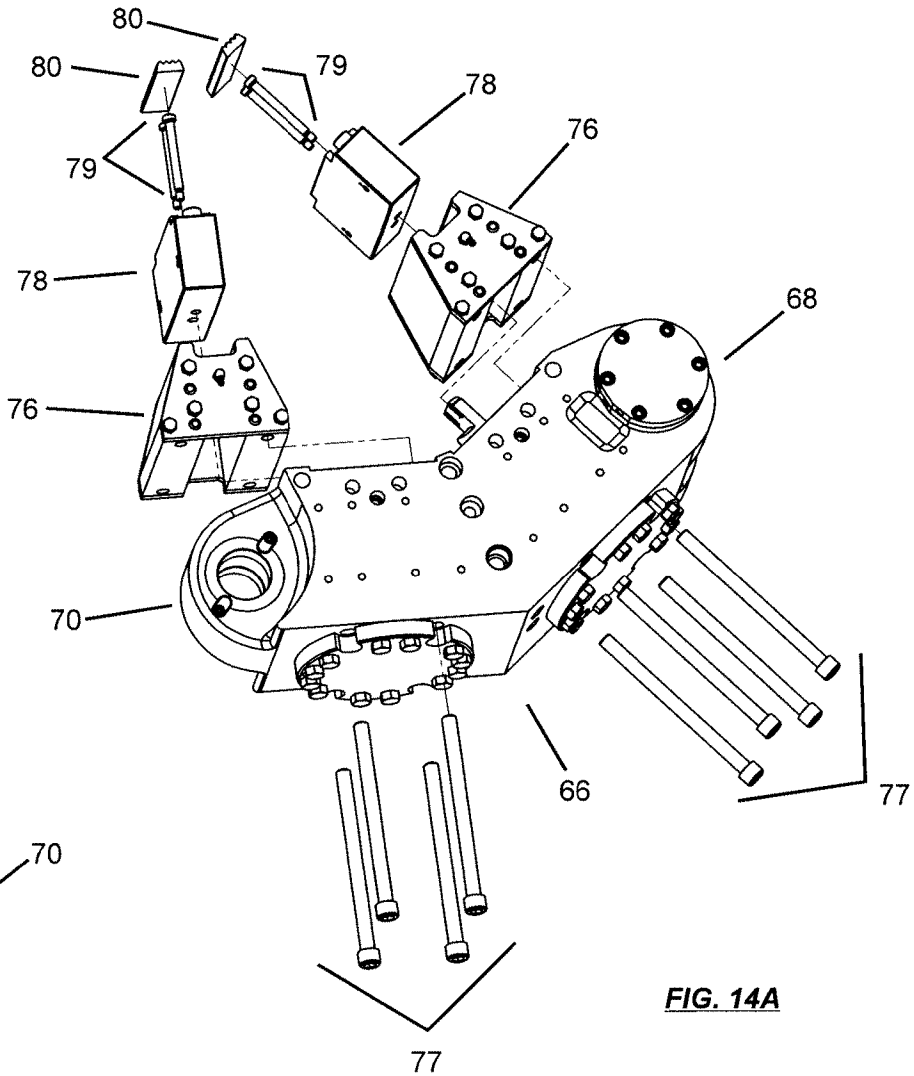
FIG. 14A is an exploded top perspective view depicting the tong block of FIG. 12.
Figure 14B:
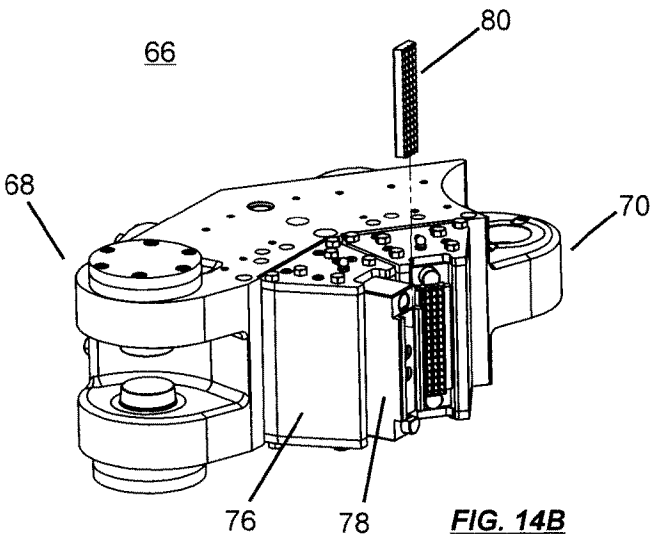
FIG. 14B is a front perspective view depicting the tong block of FIG. 14A.
Figure 15A:
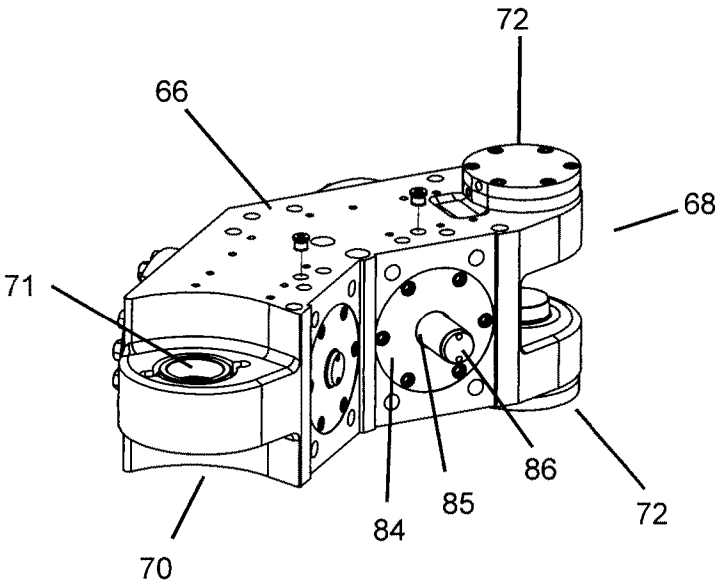
FIG. 15A is a perspective view depicting a locking tong block of FIG. 11.
Figure 15B:
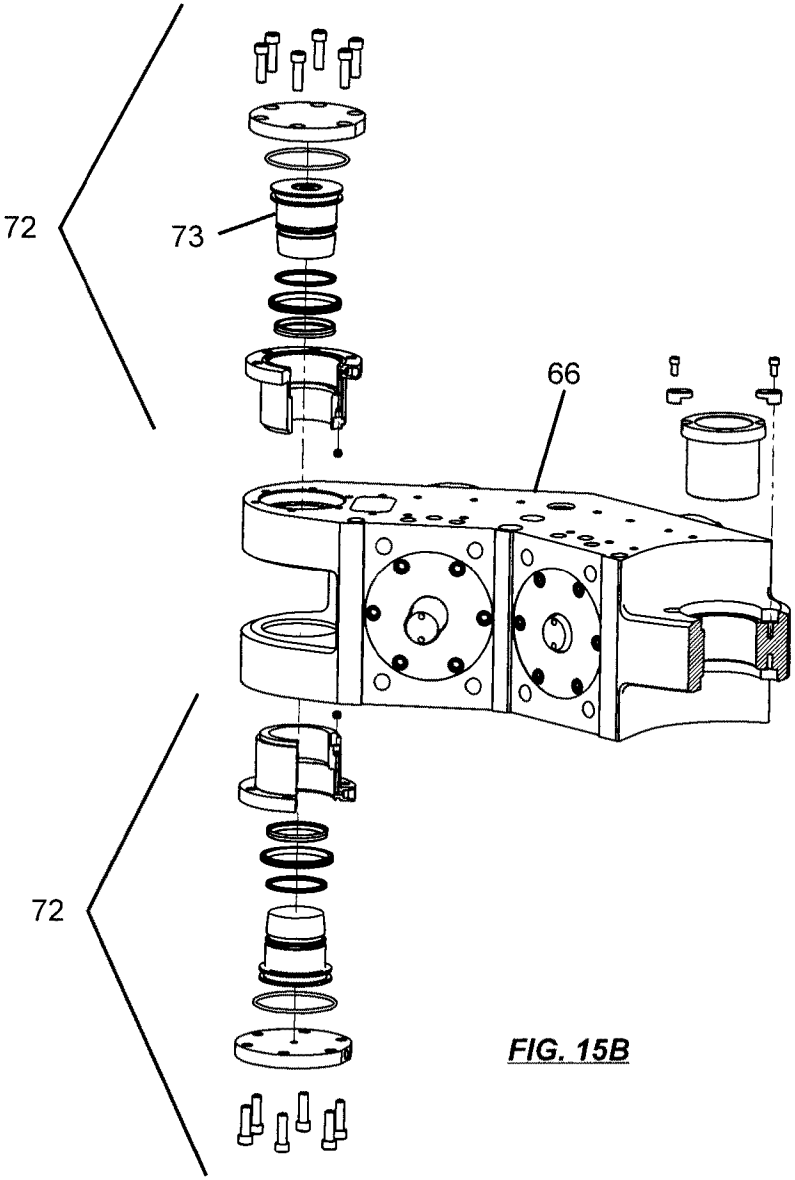
FIG. 15B is an exploded perspective view depicting the tong block of FIG. 15A.
Figure 16B:
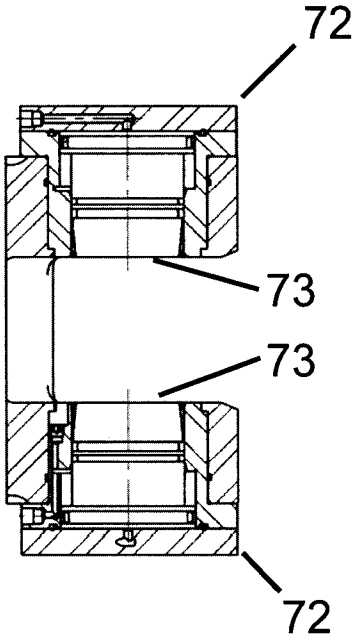
FIG. 16B is a cutaway side elevation view depicting the tong block of FIG. 16A with the lock pins in an unlocked position.
Figure 16A:
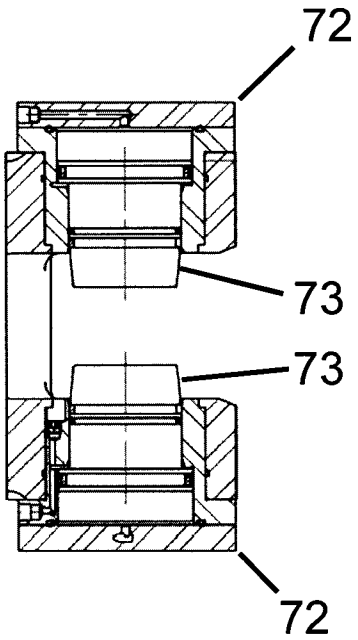
FIG. 16A is a cutaway side elevation view depicting the lock pin of the tong block of FIG. 15A with the lock pins in a locked position.
Figure 19B:
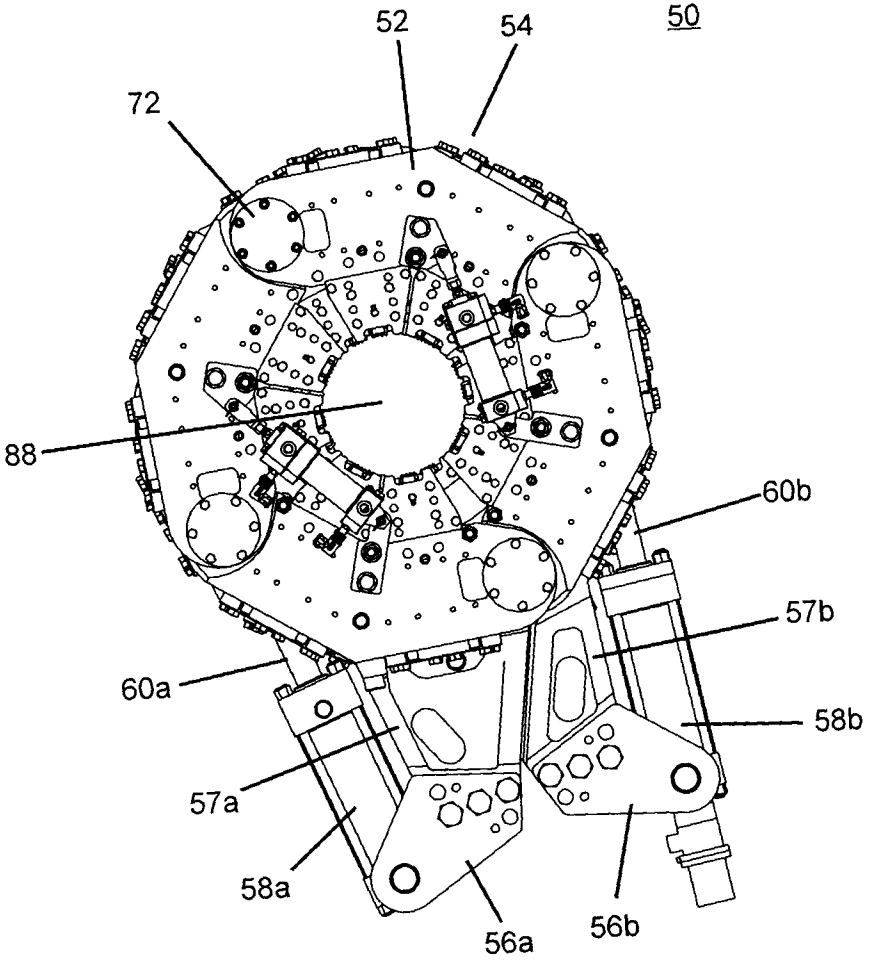
FIG. 19B is a top plan view depicting the tong assembly of FIG. 19A with upper half rotated counter-clockwise with respect to the lower half.
Figure 19A:
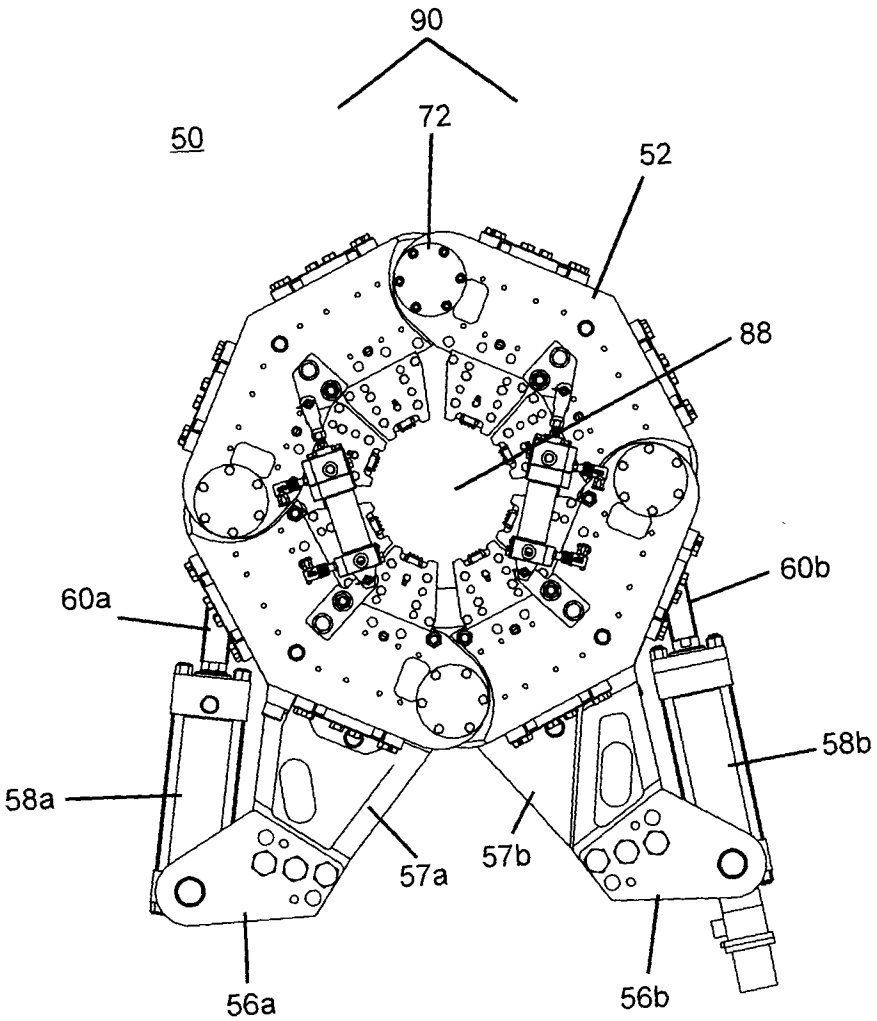
FIG. 19A is a top plan view depicting the tong assembly of FIG. 17B with the upper half aligned with the lower half.

Referring to FIGS. 9A to 10, in some embodiments, hydraulic ram 58*a* can be coupled at one end to upper tong half 52 via ram bracket 56*a* and ram mount 57*a*, which can be mounted on upper tong half 52. Ram 58*a* can operate rod 60*a*, which can be operatively coupled to rod pin 61*b* disposed on lower tong half 54. Similarly, hydraulic ram 58*b* can be coupled at one end to lower tong half 54 via ram bracket 56*b* and ram mount 57*b*, which can be mounted on lower tong half 54. Ram 58*b* can operate rod 60*b*, which can be operatively coupled to rod pin 61*a* disposed on upper tong half 52. For example, to make a pipe joint, ram 58*a* would be extended and ram 58*b* would be retracted. Conversely, to break a pipe joint, ram 58*a* would be retracted and ram 58*b* would be extended, as shown in FIGS. 19A and 19B. In this manner, the rotational forces required between upper and lower tong halves 52 and 54 to make or break pipe joints can be balanced within tong assembly 50, and minimize torque stresses to cart 14 caused by the operation of tong assembly 50.

Referring to FIGS. 9A to 11, an embodiment of tong assembly 50 is shown. In some embodiments, each of tong halves 52 and 54 can comprise a plurality of tong blocks 66 hinged together via pins 69. In a representative embodiment, each tong half can comprise four tong blocks 66. Each tong block 66 can comprise female end 68 and male 70. In some embodiments, adjacent tong blocks 66 can be pivotally joined together by inserting male end 70 of one tong block 66 into the female end 68 of another tong block 66 and pinning them together with pin 69. In some embodiments, each tong block 66 can interlock with another tong block 66. In addition, each tong block 66 can be interchanged with any other tong block 66 disposed in upper or lower tong halves 52 and 54. As shown in the figures, three pins 69 can be used to pivotally join tong blocks 66 together. At mouth 90 of each tong half, in place of a pin 69, each tong half can comprise pin lock 72 for releasably coupling adjacent tong blocks 66 together. To open mouth 90 of each tong half to receive a drill pipe in pipe opening 88, hydraulic rams 62 disposed on each of tong halves 52 and 54 between adjacent tong blocks 66 can be extended to move the outermost tong blocks 66 away from each other so that tong assembly 50 can be moved towards the drill pipe such that it is position within pipe opening 88. Once a drill pipe is within pipe opening 88, rams 62 can be retracted to close mouth 90. Once mouth 90 is closed, pin locks 72 can be operated to lock the outermost tong blocks 66 together to enclose the drill pipe within pipe opening 88.

Referring to FIGS. 11 to 16B, an exploded view of a tong half 52 or 54 is shown. In some embodiments, each tong block 66 can comprise at least one die ram 74. In the illustrated embodiment, each tong block 66 can comprise two die rams 74. Each die ram 74 can extend or retract a die 80, which can be mounted on a die holder 78, which can further be guided by a die guide 76 operatively mounted on a tong block 66. Referring to FIG. 12, an exploded view of a tong block 66 is provided. In some embodiments, each die ram 74 can comprise die ram assembly 82, which can further comprise a ram piston and ram cylinder disposed in openings in tong block 66, wherein each piston 86 can operate a ram rod 86 that can extend through aperture 85 disposed through cover 84 mounted on tong block 66, as shown in FIGS. 13A to 13C. To extend die 80, as shown in FIGS. 13A and 13B, pressurized hydraulic fluid can be applied to ram assembly 82, as well known to those skilled in the art, to move piston 96 such that it can push ram rod 86 through aperture 85 to push die holder 78 outward through die guide 76. Bolts 79 can be used to attach die holder 78 to ram rod 86. To retract die 80, as shown in FIG. 13C, hydraulic fluid can be released from ram assembly 82, as well known to those skilled in the art, to allow springs disposed within ram assembly 82 to push piston 96 back and withdraw ram rod 86 through aperture 85 such that die holder 78 can be retracted into die holder 76. Die guides 76 can be attached to tong blocks 66 with bolts 77. Dies 80 can be removably mounted on die holders 78 in slots disposed on the front faces thereof.

Referring to FIGS. 15A to 16B, one embodiment of lock pin 72 is shown. In some embodiments, each tong half 52 and 54 can comprise a tong block 66 with a female end 68 further comprising at least one lock pin 72. Lock pin 72 can comprise a hydraulically operated pin 73 disposed therein for engaging an opening 71 disposed on a male end 70 of an adjacent tong block 66. When such tong blocks 66 are positioned adjacent to one another such that male end 70 of one is inserted into female end 68 of the other, pin locks 72 can be operated to extend pins 73 into openings 71 to effectively lock the adjacent tong blocks together. To unlock pin locks 72, pins 73 can be retracted from openings 71 wherein the adjacent tong blocks 66 can be separated from one another.

Figure 17B:
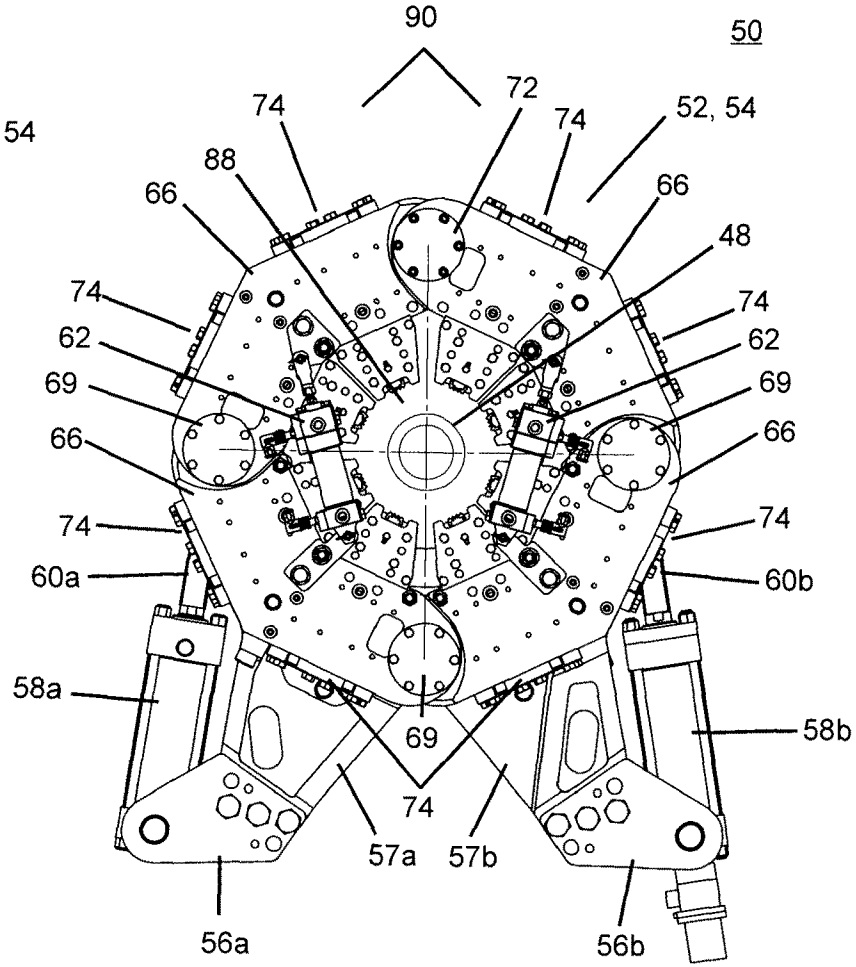
FIG. 17B is a top plan view depicting the tong assembly of FIG. 17A with the upper and lower halves in a closed position.
Figure 17A:
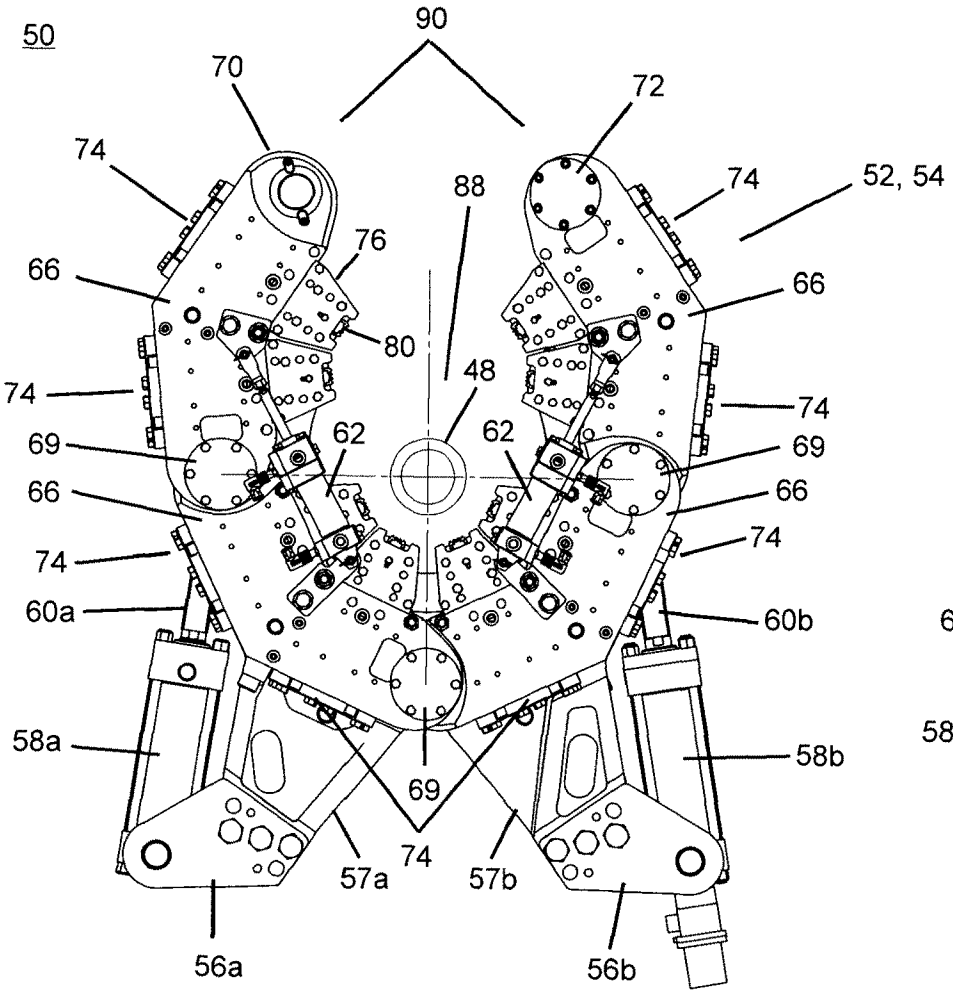
FIG. 17A is a top plan view depicting of the tong assembly of FIG. 9A with the upper and lower halves in an open position.
Figure 18:
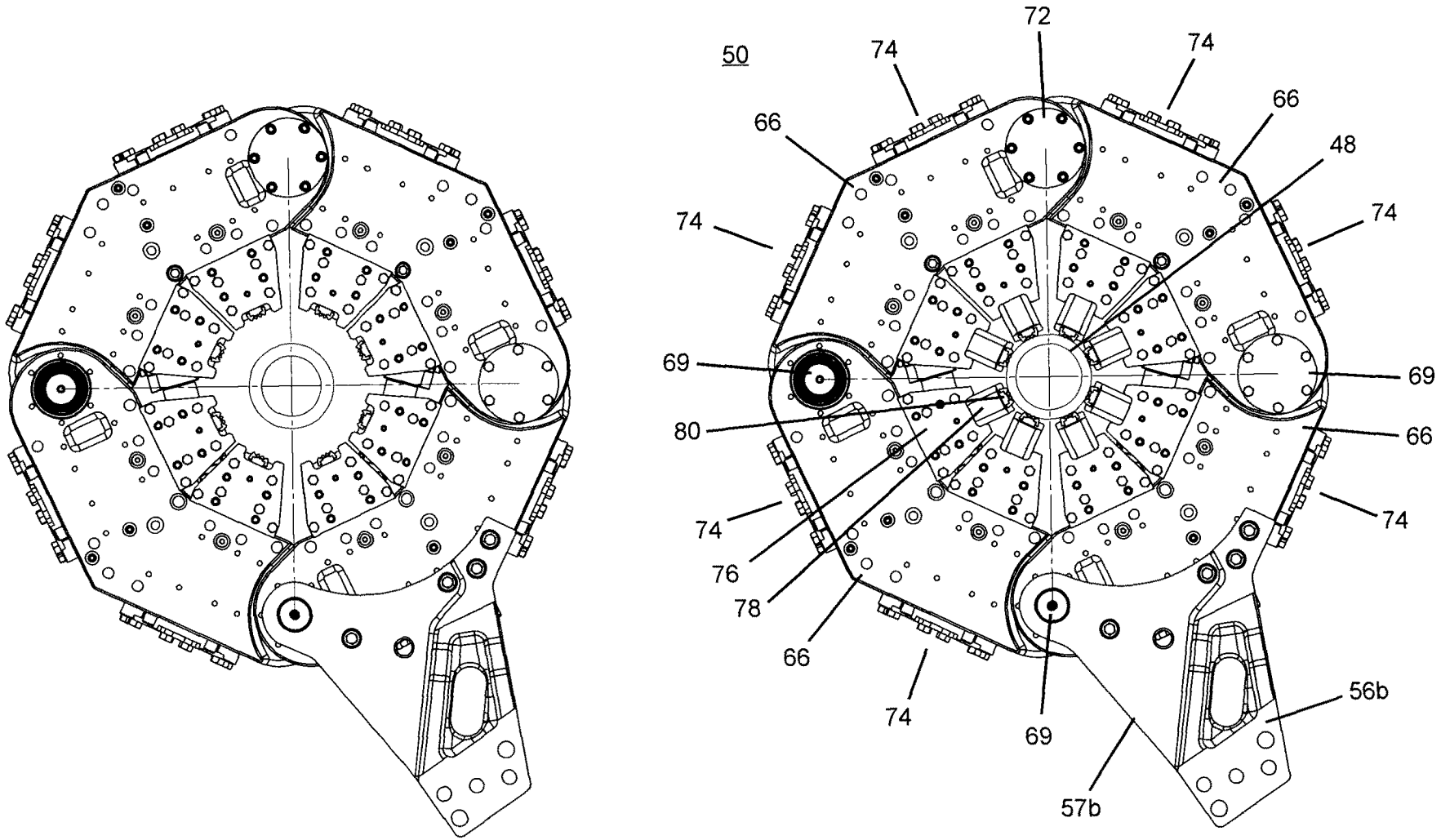
FIG. 18 is a top plan view depicting the tong assembly of FIG. 17B with the upper and lower halves clamped upon a drill pipe.

Referring to FIGS. 17A to 18, the operation of tong assembly 50 is shown. In FIG. 17A, mouths 90 of upper and lower tong halves 52 and 54 are opened by extending rams 62 to allow drill string 48 to be placed in pipe opening 88. In some embodiments, opened tong assembly 50 can be positioned by floor wrench 10 around drill string 48. In FIG. 17B, mouths 90 are closed by retracting rams 62, and upper and lower tong halves 52 and 54 are locked by operating lock pins 72. Referring to FIG. 18, each die 80 can be extended by its corresponding die ram 74 to contact drill pipe 48. In practice, the placement of tong assembly 50 relative to drill string 48 would be such that lower tong half 54 would be positioned around a box end of a lower drill pipe section and upper tong half would be positioned around a pin end of an upper drill pipe section so as to make or break a joint between the drill pipe sections that makeup drill string 48. The incorporation of eight die rams 74, as shown in the illustrated embodiment, can enable the placement of gripping force distributed equally (i.e. in equal and opposite directions) around the circumference of drill string 48 and prevent the crushing or squashing of drill string 48 such it becomes out of round when gripped by die rams 74. In addition, by distributing the gripping forces in multiple locations (i.e. a plurality of equal and opposite gripping forces) around the circumference of drill string 48, less force per die ram 74 can be used to prevent deep scoring on drill string 48 caused by dies 80, which can occur if fewer die rams are used to grip drill string 48, such as are found on similar apparatuses using only two or three die rams.

Figure 20:
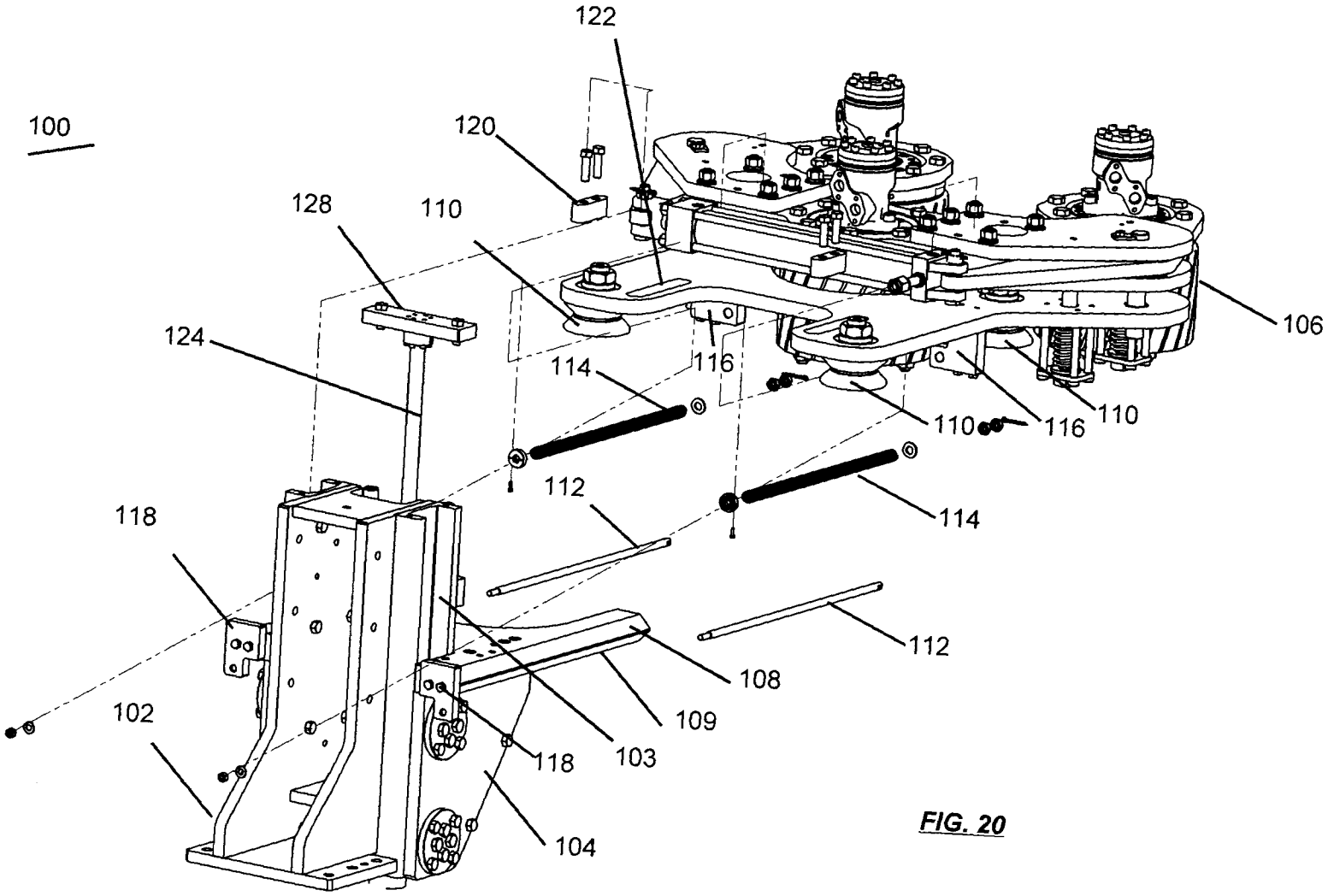
FIG. 20 is an exploded perspective view depicting the spinner assembly of the floor wrench of FIG. 1.
Figure 21:
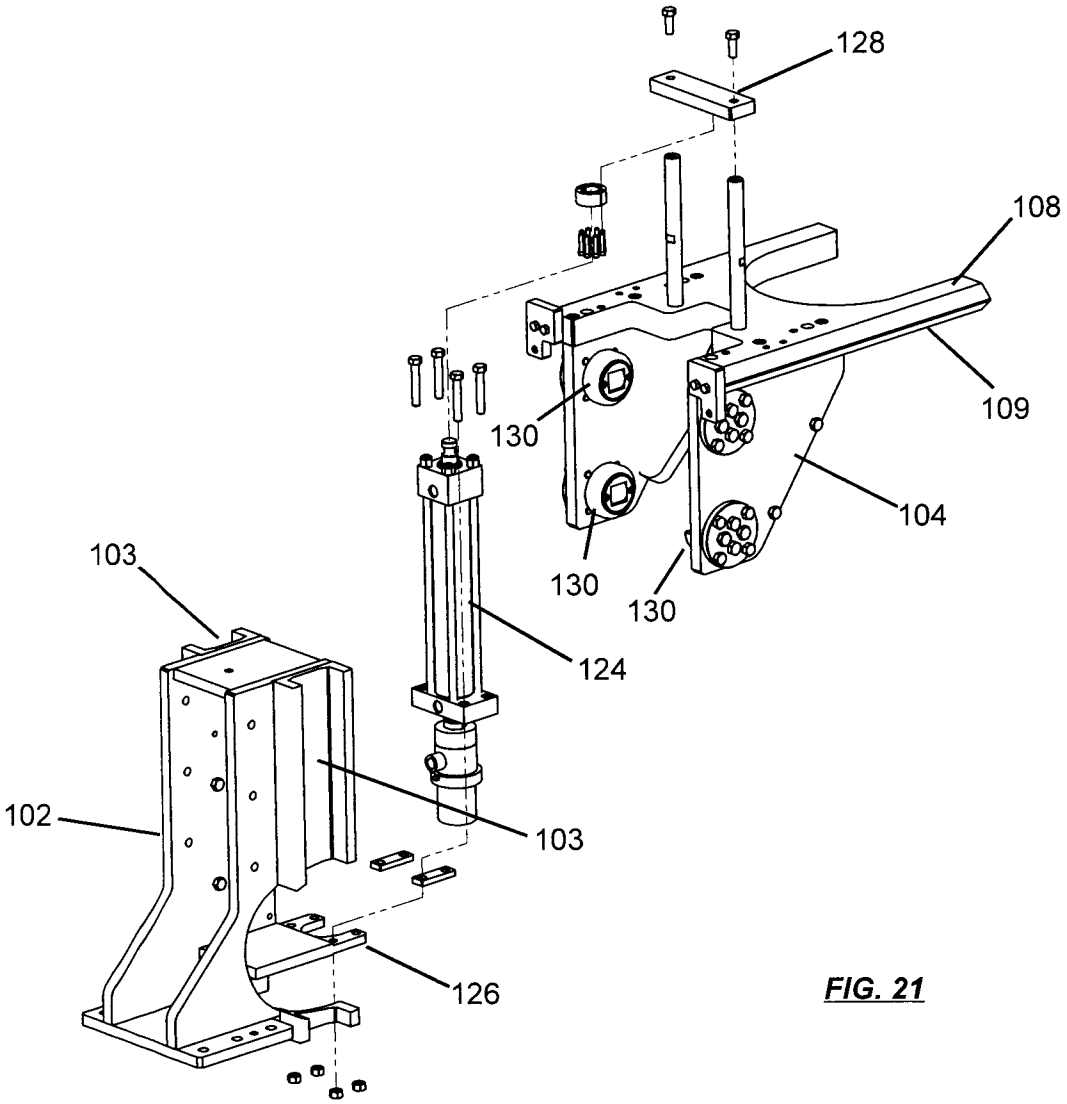
FIG. 21 is an exploded view depicting the pillar and slide plate of the spinner assembly of FIG. 20.
Figure 22:
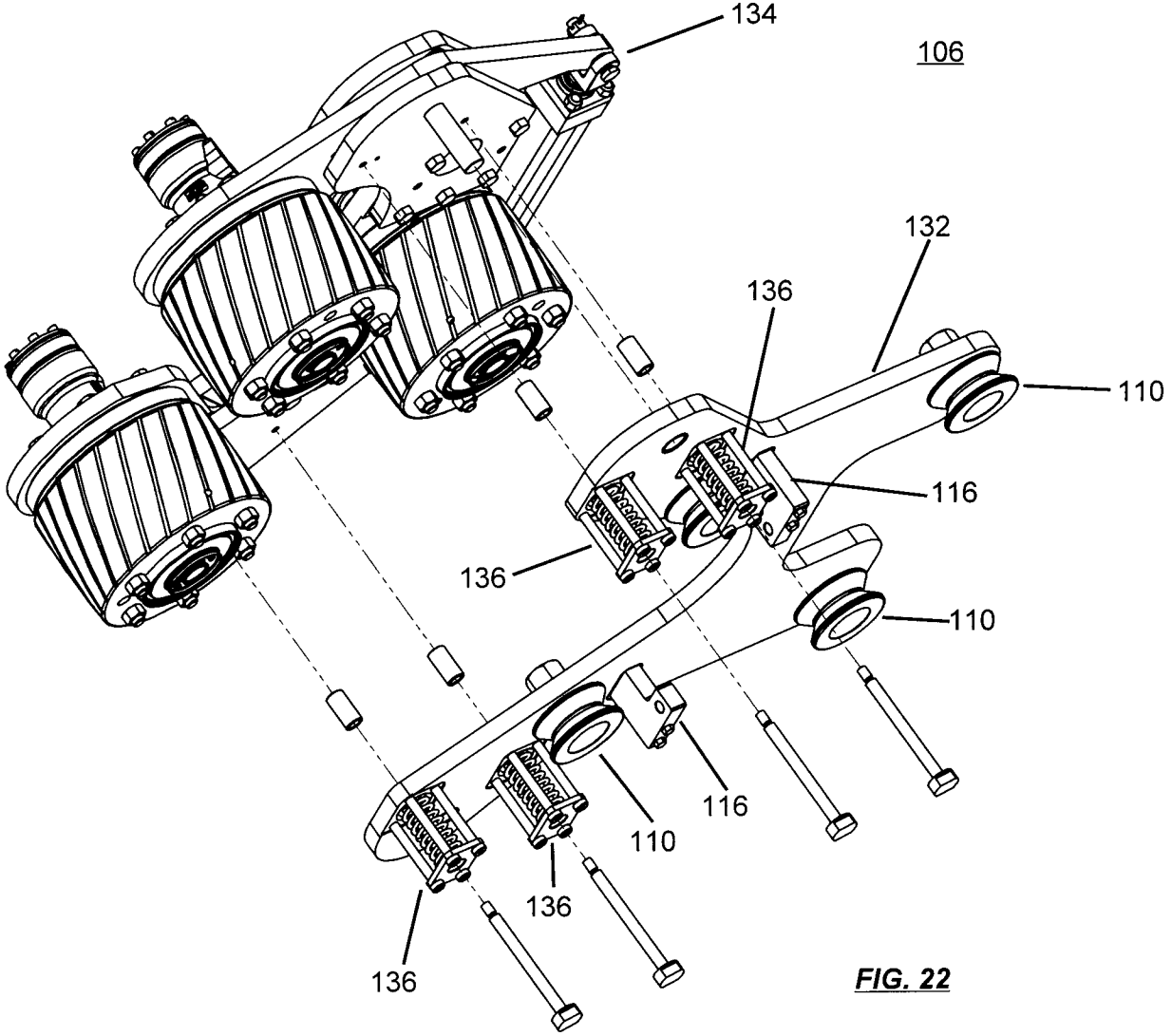
FIG. 22 is an exploded view depicting the roller assembly of the spinner assembly of FIG. 21.

Referring to FIGS. 20 to 24, an embodiment of spinner assembly 100 for use on floor wrench 10 is shown. In some embodiments, spinner assembly 100 can comprise roller assembly 106 slidably attached to slide 104, which can be configured for vertical movement on pillar 102 by rolling along tracks 103 disposed thereon, as shown in FIGS. 20 to 22. In some embodiments, slide 104 can comprise rollers 130 for rolling along tracks 103 and bracket 128 for attaching one end of hydraulic ram 124, whose other end can be attached to pillar 102 at bracket 126. By extending and retracting ram 124, slide 104 can be raised and lowered relative to pillar 102. In some embodiments, slide 104 can comprise horizontal guide plate 108 having guide edges 109. Roller assembly 106 can be slidably disposed on guide plate 108 by guiding guide rollers 110 along guide edges 109. In some embodiments, roller assembly 106 can comprise slots 122 disposed therethrough for receiving guide blocks 120 attached to guide plate 108 wherein spinner assembly 106 can move horizontally along guide plate 108. In some embodiments, spinner assembly 106 can be secured to guide plate 108 by rods 112 attached at one end to holder blocks 118 disposed on guide plate 108, the other end of rods 112 passing through apertures disposed on holder blocks 116 disposed spinner assembly 106 and secured with fasteners, for example cotter pins. In further embodiments, rods 112 can comprise springs 114 disposed therearound to provide biasing means to move spinner assembly 106 along guide plate 108.

Referring to FIG. 22, an embodiment of roller assembly 106 is shown. In some embodiments, roller assembly 106 can comprise roller subassembly 134 operatively mounted on slide plate 132 via compensation spring assemblies 136, which can be configured for suspending roller subassembly 134 above slide plate 132 and to provide means for vertical movement of roller subassembly 134 relative to slide plate 132.

Figure 23:
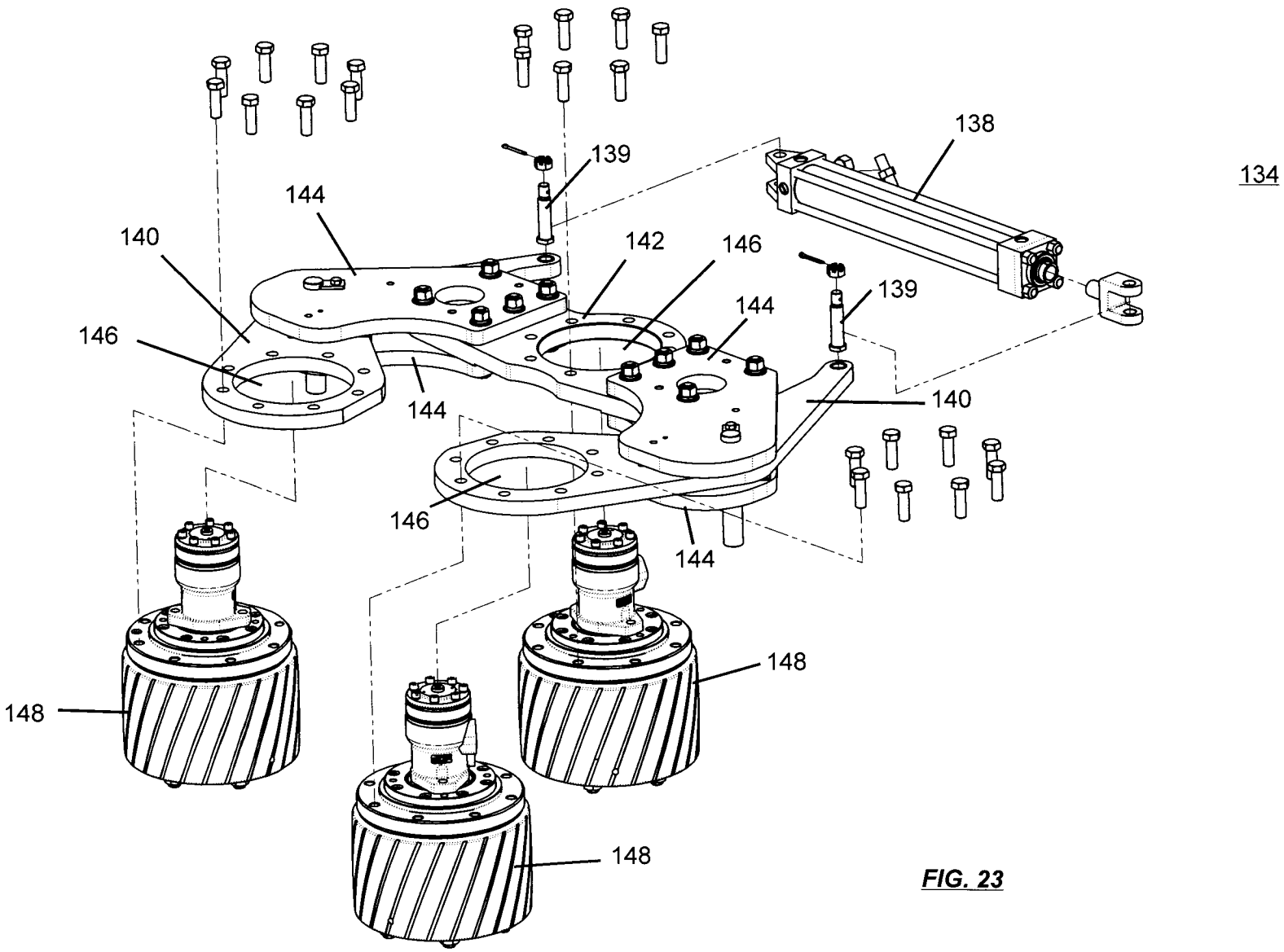
FIG. 23 is an exploded perspective view depicting the roller assembly of FIG. 22.
Figure 24:
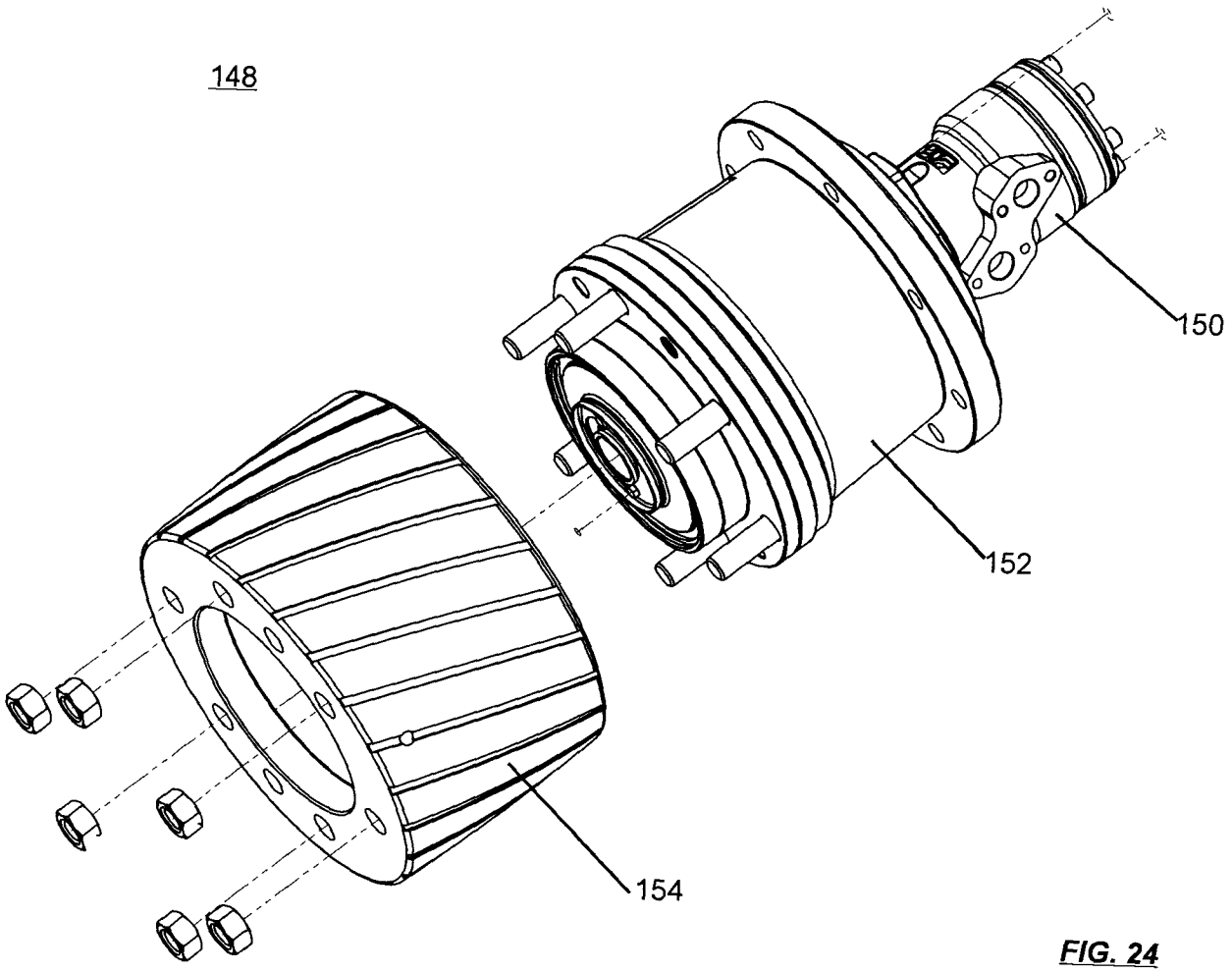
FIG. 24 is an exploded perspective view depicting a roller of the roller assembly of FIG. 23.

Referring to FIG. 23, an embodiment of roller subassembly 134 is shown. In some embodiments, roller subassembly 134 can comprise center plate 142, a pair of lever plates 140 rotatably attached to center plate 142 via attachment plates 144 and hydraulic ram 138 attached to the ends of lever plates 140 via pins 139. In some embodiments, each of center plate 142 and lever plates 140 can comprise openings 146 for receiving a roller 148 and mounting thereto. In the illustrated embodiment, roller subassembly 134 can comprise three rollers 148. By extending ram 138, rollers 148 can be drawn in towards each other; by retracting ram 138, rollers 148 can be moved away from each other. Referring to FIG. 24, an embodiment of roller 148 is shown. In some embodiments, roller 148 can comprise hydraulic motor 150 operatively coupled to gearbox 152, which can be further configured to receive roller tread 154 and removably mounted thereon.

As shown in FIGS. 1, 2A, 2C, 3A, 3B and 8A to 8C, spinner assembly 100 can be disposed above tong assembly 50. In operation, spinner assembly can be used to grasp a section of drill pipe by extending ram 138, so as to contact the drill pipe with all of the rollers 148, and rapidly spin the drill pipe. All rollers 148 can be operated to spin the drill pipe relative to another section of pipe disposed below that is gripped by lower tong half 54 of tong assembly 50. Spinner assembly 100 can be used to spin the upper drill pipe clockwise prior to making a joint with the lower drill pipe, or to spin the upper drill pipe counter-clockwise after breaking a joint with the lower drill pipe. It would be understood that the reverse motions could also be used in certain embodiments. By incorporating a plurality of rollers 148 that can rotate the drill pipe, spinner assembly 100 can quickly start threading the drill pipe sections together prior to torqueing them together with tong assembly 50 to make the joint, or quickly unthread the drill pipe sections apart after the joint is broken with tong assembly 50.

Figure 25:
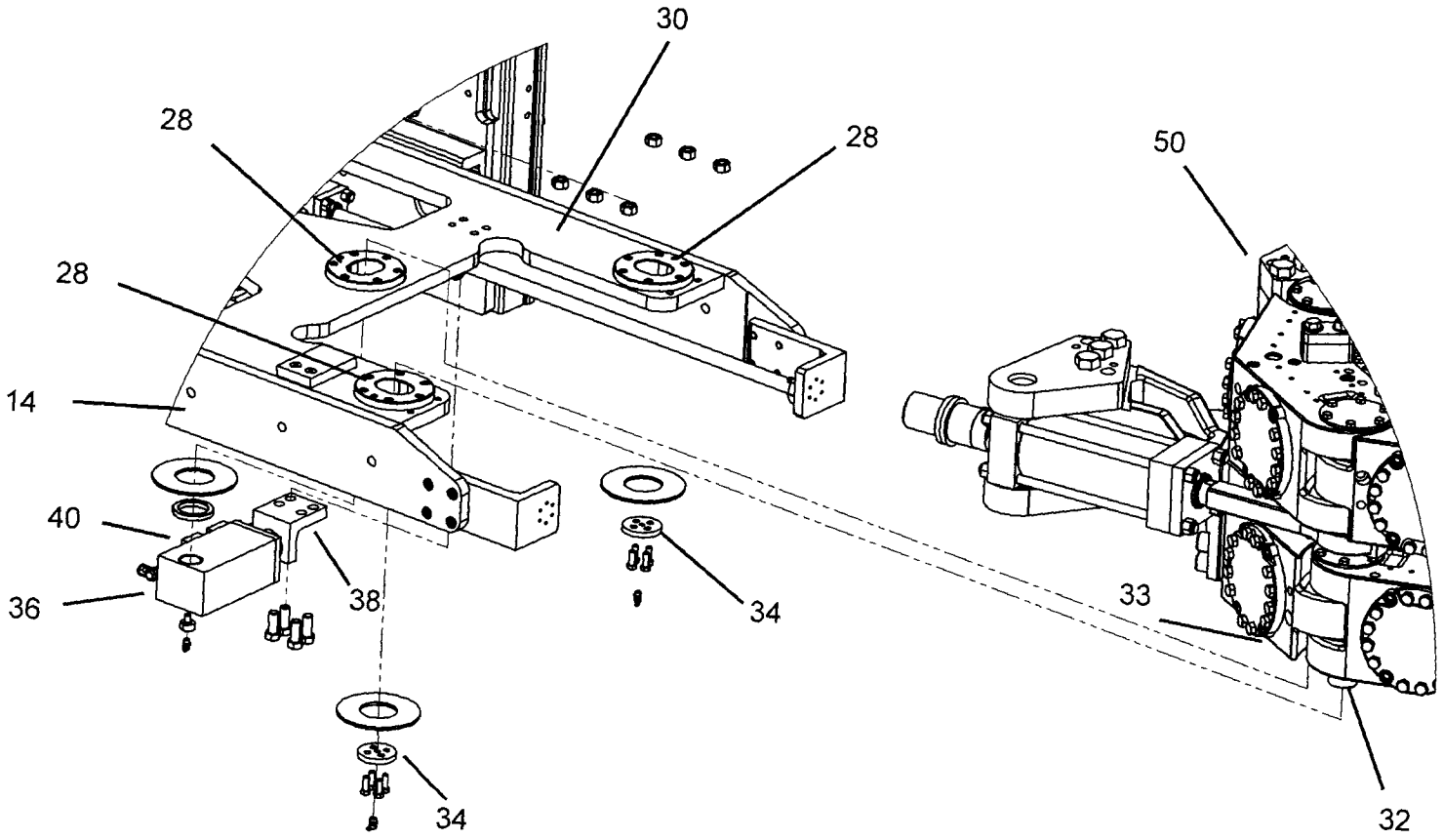
FIG. 25 is a perspective view depicting the mounting of the tong assembly of FIG. 9A onto the cart of FIG. 6.

In some embodiments, floor wrench 10 can comprise torque sensor 36 mounted thereon for measuring rotational stresses on tong assembly 50. Referring to FIG. 25, torque sensor 36 can be mounted between cart 14 and tong assembly 50. In some embodiments, tong assembly 50 can comprise pins 32 and 33 extending downwardly from lower tong half 54 that can be inserted into apertures disposed through mounting plates 28 disposed on cart 14. Bracket 38 of torque sensor 36 can be fastened to mounting holes 30 disposed in cart 14 by bolts, and pin 33 can be inserted into aperture 40 disposed through torque sensor 36 and secured thereto. Retainer plates 34 can then be fastened to pins 32 to secure tong assembly 50 to cart 14.

Figure 26A:
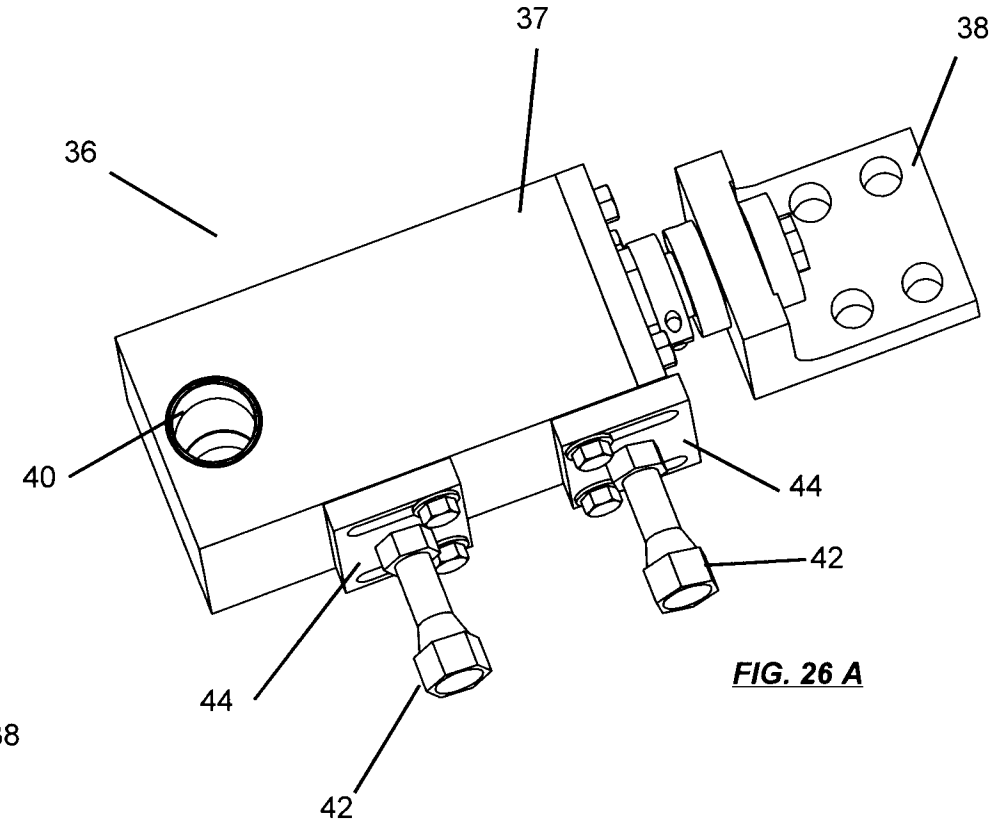
FIG. 26A is a perspective view depicting a torque sensor for the floor wrench of FIG. 1.
Figure 26B:
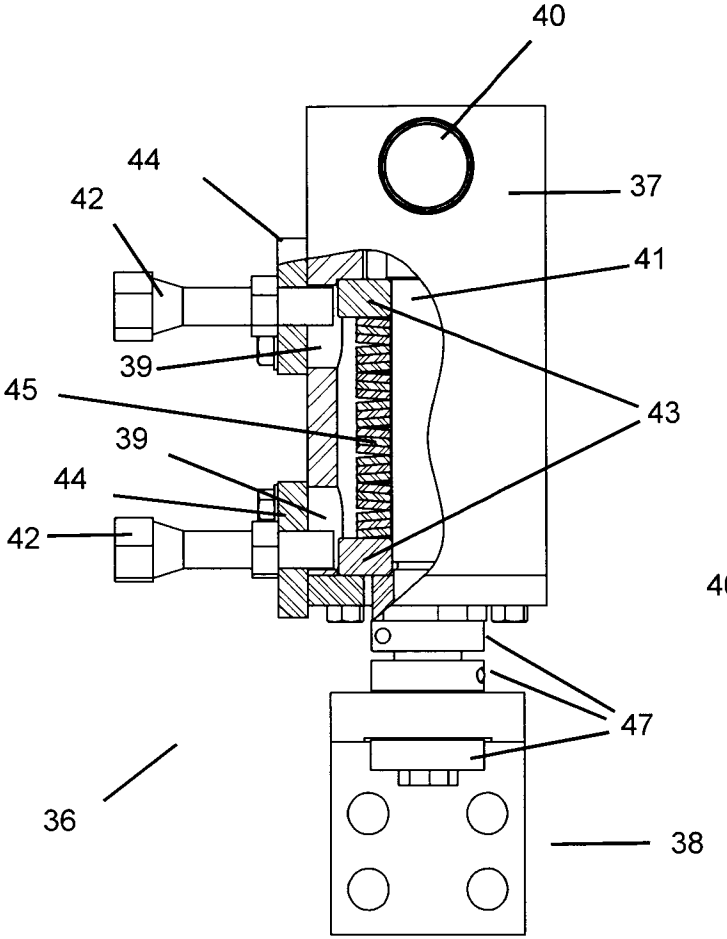
FIG. 26B is a cutaway top plan view depicting the torque sensor of FIG. 26A.
Figure 27:
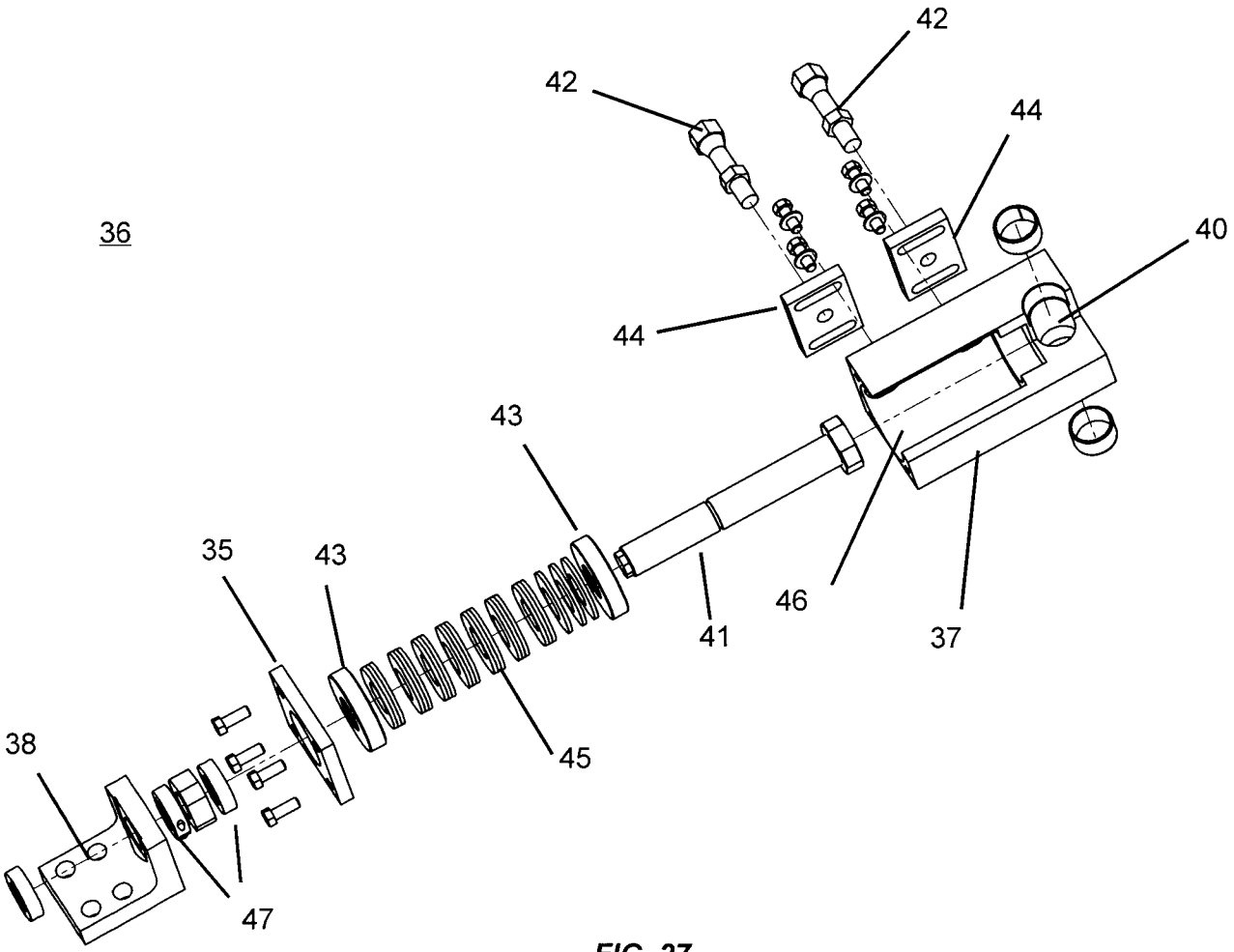
FIG. 27 is an exploded perspective view depicting the torque sensor of FIG. 26A.

Referring to FIGS. 26A to 27, an embodiment of torque sensor 36 is shown. In some embodiments, torque sensor 36 can comprise housing 37 having chamber 46 therein and slots 39 disposed through a sidewall of housing 37. The internal mechanism of sensor 36 can comprise bolt 41 passing collars 43 and spring washers 45 before passing through end cap 35. End cap 35 can be attached to housing 37 once the internal mechanism is placed in chamber 46. The end of bolt 41 extending through end cap 35 can be attached to bracket 38, which can be attached to cart 14 as described. In some embodiments, sensors 42 can be mounted on sensor mounts 44 to be positioned in slots 39. Mounts 44 can be configured for side to side movement when attached to housing 37 to allow sensors 42 to be properly positioned within slots 39 with respect to collars 43. In some embodiments, sensors 42 can comprise magnetic sensors or Hall effect devices, and collars 43 can comprise materials suitable for operation with such devices, as well known to those skilled in the art.

In operation, by placing torque sensor between mount pin 33 extending from tong assembly 50 and cart 14, rotational force between tong assembly 50 and cart 14 can be monitored. It is known that when automated floor wrenches are used on drilling rigs using top drives for rotating the drill string, drilling operators have been known to use the top drive to make joints between sections of drill pipe instead of using the automated floor wrench. Top drives can produce large amounts of torque, far more than what is necessary to properly torque sections of drill pipe together. Using the top drive to make the joints can apply excessive rotational force to the automated floor wrench, which is still being used to grip to lower section of drill pipe, and cause damage to the floor wrench. By incorporating torque sensor 36 in the mounting of tong assembly 50 to cart 14, torque sensor 36 can be used to sense when excessive rotational force is applied to the floor wrench. Sensors 42 can be positioned in slots 39 such when excessive rotational force is applied to lower tong half 54, collars 43 move relative to sensors 42, which can be operatively connected to control system 18. Once collars 43 move sufficiently relative to sensors 42, sensors 42 can send a signal to control system 18 that can, in turn, cause tong assembly 50 to release any pipe gripped by it. In the instance when floor wrench 10 is used with a top drive drilling rig, and its operators simply use floor wrench 10 to grip the drill string with lower tong half 54 and use the top drive to make joints with the drill string, torque sensor 36 can be used to sense when the rotational force is applied to longer tong half 54 by the top drive exceeds a predetermined threshold, and send a signal to control system 18 to cause lower tong half 54 to release the drill string, thereby preventing damage to floor wrench 10. In further embodiments, control system 18 can also shut down the operation of the top drive and any other system that was operating prior to torque sensor 36 sending the signal to control system 18.

In other operational situations, such as during break-out operations, it is known that a drill string can slip in a lower tong when the upper tong is trying to break a joint in adjacent sections of pipe in the drill string. When this occurs, excessive rotational forces can occur in lower tong half 54, which can damage cart 14 and manipulator frame 12. By connecting torque sensor 36 between lower tong half 54 and cart 14, such rotational forces can be detected by torque sensor 36. When the rotational forces exceed a predetermined threshold such that collars 43 move relative to sensors 42 within torque sensor 36, sensors 42 can send a signal to control system 18 to, in turn, cause tong assembly 50 to release the drill string. In further embodiments, control system 18 also shut down the operation of the top drive and any other system that was operating prior to torque sensor 36 sending the signal to control system 18.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. A floor wrench for use on a drilling rig, the floor wrench comprising:

a manipulator frame configured for mounting on a drilling rig floor;

a cart frame disposed within the manipulator frame, the cart frame configured for vertical movement within the manipulator frame;

a manipulator cart disposed within the cart frame, the manipulator cart configured for horizontal movement within the cart frame;

a power tong assembly disposed on the manipulator cart, the power tong assembly configured for making and breaking joints between sections of drilling pipe; and a control system configured for controlling the movement of the cart frame within the manipulator frame, the movement of the manipulator cart within the cart frame, and the operation of the power tong assembly, wherein the manipulator frame is configured for horizontal movement along manipulator frame tracks, wherein the power tong assembly comprises an upper tong disposed above a lower tong, the upper and lower tongs configured for rotational movement in a substantial horizontal plane relative to each other, the upper and lower tongs further configured for opening and enclosing a joint between the sections of drilling pipe, wherein each of the upper and lower tongs comprises a plurality of articulated tong blocks, wherein each of the tong blocks are connected to one another by a hinge; and wherein each of the articulated tong blocks are interchangeable with one another and comprise an interlocking configuration, and wherein each of the articulated tong blocks comprise at least one die ram assembly for imposing a plurality of equal and opposite gripping forces distributed equally around the circumference of the drill pipe.

2. The floor wrench as set forth in claim 1, wherein each of the upper and lower tongs comprises a lock configured for locking a pair of adjacent tong blocks together.

3. The floor wrench as set forth in claim 1, wherein each tong block comprises two die ram assemblies.

4. The floor wrench as set forth in claim 1, further comprising a spinner assembly disposed on the manipulator cart above the power tong assembly, the spinner assembly configured for spinning a section of drilling pipe.

5. The floor wrench as set forth in claim 4, wherein the spinner assembly comprises:

a) a pillar disposed on the manipulator cart; and b) a roller assembly disposed on a slide, the slide configured for vertical movement on the pillar.

6. The floor wrench as set forth in claim 5, wherein the roller assembly comprises a plurality of powered rollers mounted on a roller frame, the roller frame configured for moving the powered rollers away from each other to receive the section of drilling pipe and for moving the powered rollers towards and spinning the section of drilling pipe.

7. The floor wrench as set forth in claim 6, wherein each powered roller comprises a hydraulic motor operatively coupled to an input of a gearbox, and a roller wheel operatively coupled to an output of the gearbox.

8. The floor wrench as set forth in claim 4, wherein the control system is further configured for controlling the operation of the spinner assembly.

9. The floor wrench as set forth in claim 1, wherein the control system comprises one or more of a group consisting of hydraulic fluid cylinders, hydraulic fluid pumps, hydraulic fluid tanks, hydraulic fluid coolers, hydraulic fluid filters, hydraulic fluid hoses, hydraulic fluid control valves and programmable logic controllers.

10. The floor wrench as set forth in claim 1, further comprising a torque sensor disposed between the power tong assembly and the manipulator cart, the torque sensor operatively coupled to the control system, the torque sensor configured to sense rotational forces applied to the power tong assembly during operation of the floor wrench and to send a signal to the control system to stop the operation of the floor wrench when the rotational forces exceed a predetermined threshold.

11. The floor wrench of claim 1, wherein the hinge comprises a pin.

12. A method of making or breaking a joint between sections of drilling pipe at a drilling rig, the method comprising:

providing a manipulator frame mounted on a drilling rig floor, the manipulator frame slidably disposed on manipulator frame tracks, wherein the manipulator frame comprises a cart frame disposed therein, and wherein the cart frame comprises a manipulator cart slidably disposed therein;

providing a power tong assembly disposed within the manipulator cart, wherein the power tong assembly comprises an upper tong disposed above a lower tong, the upper and lower tongs configured for rotational movement in a substantial horizontal plane relative to each other, wherein each of the upper and lower tongs comprises a plurality of articulated tong blocks connected via a hinge, wherein each of the articulated tong blocks are connected to an adjacent tong block via a hinge, comprise substantially the same shape and are interchangeable with one another;

wherein the plurality of interlocking tong blocks comprise an interlocking configuration;

wherein each of the articulated tong blocks comprise at least one die ram assembly for imposing a plurality of equal and opposite gripping forces distributed equally around the circumference of the drill pipe;

providing a control system configured for controlling the movement of the cart frame within the manipulator frame, the movement of the manipulator cart within the cart frame, and the operation of the power tong assembly;

moving the manipulator cart horizontally along the drilling rig floor to position the power tong assembly around a first section of drilling pipe;

closing the power tong assembly around the first section of drilling pipe;

activating the least one die ram assembly disposed on the power tong assembly to extend dies towards the first section of drilling pipe to grip the first section of drilling pipe; and rotating the power tong assembly and the gripped first section of drilling pipe relative to a second section of drilling pipe to make or break a joint between the first and second section of drilling pipe.

13. The method as set forth in claim 12 further comprising locking the power tong assembly around the first section of drilling pipe after the power tong assembly is closed.

14. The method as set forth in claim 12 further comprising using a spinner assembly disposed on the manipulator cart above the power tong assembly to engage and spin the second section of drilling pipe relative to the first section of drilling pipe.

15. The method as set forth in claim 12 further comprising using a torque sensor to sense rotational forces applied to the power tong assembly during operation of the floor wrench.

16. The method as set forth in claim 15 further comprising sending a signal from the torque sensor to a control system to stop the operation of the floor wrench when the rotational forces exceed a predetermined threshold.

17. The method as set forth in claim 15 further comprising sending a signal from the torque sensor to a control system to cause the tong assembly to release the drilling pipe when the rotational forces exceed a predetermined threshold.

18. The method of claim 12, wherein the hinge connecting the plurality of articulated tong blocks comprises a pin.

* * * * *